US011273541B2

(12) United States Patent
Clark

(10) Patent No.: US 11,273,541 B2
(45) Date of Patent: Mar. 15, 2022

(54) AUTOFEED SCREWDRIVER ATTACHMENT WITH TWIST COLLAR TO ACTIVATE MOVABLE PLATES FOR LATCHING TO SCREW GUN

(71) Applicant: Kyocera Senco Industrial Tools, Inc., Cincinnati, OH (US)

(72) Inventor: Chad L. Clark, Goshen, OH (US)

(73) Assignee: Kyocera Senco Industrial Tools, Inc., Cincinnati, OH (US)

( * ) Notice: Subject to any disclaimer, the term of this patent is extended or adjusted under 35 U.S.C. 154(b) by 448 days.

(21) Appl. No.: 16/443,410

(22) Filed: Jun. 17, 2019

(65) Prior Publication Data

US 2020/0298382 A1 Sep. 24, 2020

Related U.S. Application Data

(60) Provisional application No. 62/820,037, filed on Mar. 18, 2019.

(51) Int. Cl.
*B25B 23/04* (2006.01)
*B25B 21/00* (2006.01)

(52) U.S. Cl.
CPC ..... *B25B 23/045* (2013.01); *B25B 21/002* (2013.01)

(58) Field of Classification Search
CPC . B25B 23/00; B25B 23/0007; B25B 23/0014; B25B 23/0021; B25B 23/0028; B25B 23/0035; B25B 23/0042; B25B 23/005; B25B 23/02; B25B 23/04; B25B 23/045; B25B 23/06; B25B 23/064; B25B 23/065; B25B 21/00; B25B 21/002; B25C 5/02; B25C 5/06
See application file for complete search history.

(56) References Cited

U.S. PATENT DOCUMENTS 2,374,558 A 4/1945 Moore
5,083,483 A 1/1992 Takagi
(Continued)

FOREIGN PATENT DOCUMENTS

EP 2786842 10/2014

OTHER PUBLICATIONS

International Search Report, PCT/US20/20325, 18 pages (dated May 20, 2020).

*Primary Examiner* — Robert J Scruggs
(74) *Attorney, Agent, or Firm* — Frederick H. Gribbell; Russell F. Gribbell

(57) ABSTRACT

An autofeed attachment designed for mounting to a manual-feed screwgun that has a recessed channel on the exterior surface near a protruding flange. The autofeed attachment has at least one movable plate that is forced inward by a ramp structure on the interior surface of a rotatable collar. When the collar is rotated in a predetermined direction, the ramp surface acts to force the movable plate toward the interior, until that movable plate comes into contact into the recessed channel on the screwgun. Once that has occurred, the autofeed attachment will now be locked into place into that recessed channel and behind a protruding flange of the screwgun. The movable plate(s) is positioned between two retainer structures that are spaced-apart from one another, and create a gap through with the at least one movable plate can move during the locking, and later unlocking operations, by twisting the rotatable collar.

23 Claims, 15 Drawing Sheets

(56) References Cited

U.S. PATENT DOCUMENTS

| | | | | |
|---|---|---|---|---|
| 6,328,746 | B1 | 12/2001 | Gambale | |
| 6,511,484 | B2 | 1/2003 | Torode | |
| 6,601,480 | B1 * | 8/2003 | Habermehl | F16B 27/00 81/434 |
| 6,758,116 | B2 * | 7/2004 | Kriaski | B25B 23/0064 173/13 |
| 7,032,482 | B1 | 4/2006 | Hoffman | 81/434 |
| 7,134,367 | B2 | 11/2006 | Gehring | |
| 7,406,899 | B2 | 8/2008 | Walker | |
| 7,413,029 | B2 | 8/2008 | Seno | |
| 7,448,342 | B2 | 11/2008 | Von Schuckmann | |
| 7,458,295 | B1 | 12/2008 | Lu | |
| 7,493,839 | B2 | 2/2009 | Massari, Jr. | |
| 7,793,572 | B2 * | 9/2010 | Hirt | B25F 3/00 81/473 |
| 7,997,171 | B2 | 8/2011 | Massari, Jr. | |
| 8,869,656 | B2 * | 10/2014 | Desmond | B25B 23/045 81/57.37 |
| 9,616,557 | B2 | 4/2017 | Hays | |
| 2004/0093991 | A1 | 5/2004 | Wojtynek | |
| 2006/0112794 | A1 | 6/2006 | Lai | |
| 2010/0179599 | A1 | 7/2010 | Walker | |
| 2014/0260831 | A1 * | 9/2014 | Hays | B25B 21/00 81/434 |

* cited by examiner

AUTOFEED SCREWDRIVER ATTACHMENT WITH TWIST COLLAR TO ACTIVATE MOVABLE PLATES FOR LATCHING TO SCREW GUN

CROSS-REFERENCE TO RELATED APPLICATIONS

The present application claims priority to provisional patent application Ser. No. 62/820,037, titled "AUTOFEED SCREWDRIVER ATTACHMENT WITH TWIST COLLAR TO ACTIVATE MOVABLE PLATES FOR LATCHING TO SCREW GUN," filed on Mar. 18, 2019.

TECHNICAL FIELD

The technology disclosed herein relates generally to automatic screwdriving equipment and is particularly directed to an autofeed attachment of a type that can be mounted to a manual-feed screw gun, thereby converting the overall tool "system" into an automatic feed screw gun. Embodiments are specifically disclosed as having a pair of movable plates that can be forced inward by rotation of an outer rotatable collar that has a pair of ramps that are inclined (protruding by a varying distance) toward the middle portion of the attachment. When the ramps are rotated as part of the collar, that action forces the movable plates toward the center of the attachment. This moving plate action forces the movable plates to be pressed against a recessed channel in the manual-feed screw gun, and behind a protruding flange on the manual-feed screw gun, thereby locking the autofeed attachment onto the front portion of the housing of the manual feed screw gun.

The attachment includes an adapter portion that has the rotatable collar along its outer surface, and includes a first retainer on one side of the movable plates and a second retainer on the opposite side of the movable plates. The two retainers are spaced-apart from one another, thereby creating a gap or space through which the two movable plates can travel as they are moved from their locking, engagement position to their non-locking, non-engagement position, and vice versa.

The movable plates each have a rounded or "first contact surface" that is forced into contact with one of the ramps when the rotatable collar is twisted by a human user, as the human user is trying to mount the attachment to the manual-feed screw gun. When the ramp forces the first contact surface of the plate inward, on the opposite side of the plate is a second contact surface that will eventually come into contact with the recessed channel of the manual-feed power tool's front housing portion. At that time, the movable plates will become locked into that orientation, thereby latching or locking the autofeed attachment to the manual-feed power tool. When it is time to un-latch the tool from the autofeed attachment, the human user rotates the rotatable collar in the opposite direction, and small coil springs that are mounted between the two movable plates will force the movable plates apart from one another, thereby releasing the second contact surface of the plates from making contact with the recessed channel of the manual-feed screw gun tool. When the rotatable collar has been twisted a sufficient angular distance, the second contact surface of the movable plates will have cleared the protruding flange of the manual-feed screw gun, and the autofeed attachment can be completely dismounted from the manual-feed screw gun.

STATEMENT REGARDING FEDERALLY SPONSORED RESEARCH OR DEVELOPMENT

None.

BACKGROUND

Several manufacturers of power tools sell manually-fed ("single-feed") screwdriving tools, and some of those manufacturers also sell "autofeed" screwdriving tools. The autofeed screwdriving tools typically use some type of collated strips that hold multiple screws at fairly precise intervals, and these collated strips of screws are fed into an indexing mechanism at the front portion of the autofeed screwdriving tool. The user has to merely place the front tip of the tool against a workpiece, and then pull the trigger on the tool while pressing the tool against the workpiece. When that occurs, the tool will automatically index a screw to the "driving position," and a drive bit will begin turning and will be pushed into the head of the screw, and then drive the screw all the way into the workpiece. This type of tool is well-known, and often used by professional carpenters and other construction workers.

The manually-fed screwdriving tools are used in many other situations, including people who are not necessarily professional construction workers, but nevertheless want to have a power tool for driving screws. Even professional carpenters and other construction workers will sometimes use a non-autofeed screwdriving tool, for certain purposes. This is especially popular in situations where a person already has a manually-fed screwdriving tool, but also purchases an autofeed attachment that can be affixed to the front end of the manually-fed screwdriving tool, thereby converting it into an automatic screwdriving gun. Such attachments also are well-known and popular in many construction situations.

One popular manual-feed screwdriving gun is made by DeWalt, under the model number DCF620. A portion of that type of tool is illustrated in FIGS. 6 and 7, herein. The DeWalt manual-feed screw gun is generally depicted by the reference numeral 2 (showing only a portion of the device), whereas the nose portion of screw gun 2 is generally depicted by the reference numeral 3. The very front nose of the tool has a rounded portion 4 and a flat portion 5. Those rounded and flat surfaces are used by DeWalt for mounting their own autofeed attachment. The nose portion 3 also includes a protruding flange 6, and a recessed channel 7 that is "behind" the flange (with respect to the front nose portion of the tool).

The DeWalt DCF620 apparently is a popular tool, so much so that other companies sell attachments that can mount to this DeWalt tool. For example, Grabber sells such an attachment under the product name "SuperDrive N7." This Grabber device has a rotatable locking collar that pushes down a ball bearing-type fixture that slides into the recess slot 7 of the DeWalt tool's front end. Other configurations can be provided for mounting an autofeed screw gun attachment to the DeWalt tool.

SUMMARY

Accordingly, it is an advantage to provide an autofeed attachment that converts a manual-feed screw gun into an automatic-feed screw gun, in which that attachment has mechanical parts that fit into a recessed channel on the front housing of the manual-feed screw gun, and also fits proximal to a protruding flange on the manual-feed screw gun.

It is another advantage to provide an autofeed attachment that uses a twist collar to force at least one slidable plate into a position where it contacts a recessed channel on a manual-feed screw gun, so as to hold the attachment into a fixed relationship with that manual-feed screw gun.

It is yet another advantage to provide an autofeed attachment that uses at least one ramp structure having a variable distance protruding from the interior or inner diameter of a rotatable collar, in which the contact between the ramp and at least one movable plate will force that plate inward until it makes contact with a recessed channel on a manual-feed screw gun, thereby creating a fixed attachment relationship between the autofeed attachment and the manual-feed screw gun.

It is still another advantage to provide an autofeed attachment for mounting to a manual-feed screw gun in which the attachment has at least one movable plate that is forced to move by rotation of an outer collar, and the attachment has a first retainer mounted on one side of the movable plate, and a second retainer mounted on the opposite side of the movable plate, in which the two retainers create a space for movement of the plates from their opened or unlatched position, toward their closed or latched (locked) position.

Additional advantages and other novel features will be set forth in part in the description that follows and in part will become apparent to those skilled in the art upon examination of the following or may be learned with the practice of the technology disclosed herein.

To achieve the foregoing and other advantages, and in accordance with one aspect, an autofeed screw gun attachment is provided, which comprises: (a) a housing having an open first end used for attaching and an opposite, second end used for driving a fastener, the housing having a longitudinal axis that extends through at least a portion of the open first end; (b) an adapter portion proximal to the open first end, the adapter portion comprising: (i) a rotatable collar having a rounded exterior surface that is graspable by a human hand, the rotatable collar having a rounded interior portion that includes at least one ramp that protrudes inward at a non-uniform distance along an inner circumference of the rounded interior portion; (ii) at least one movable plate that is mounted within an interior volume of the rotatable collar, the at least one movable plate having a first surface that is sized and shaped to make physical contact with the at least one ramp of the rotatable collar, the at least one movable plate having a second surface that is sized and shaped to act as a locking surface; (iii) at least one biasing member for urging the movable plate toward a first position that is distal from the longitudinal axis; (iv) a first retainer that is mounted within the housing, the first retainer being positioned proximal to a first side of the at least one movable plate, the first side being proximal to the open first end of the housing; (v) a second retainer that is mounted within the housing, the second retainer being positioned proximal to a second, opposite side of the at least one movable plate, the second side being more distal from the open end of the housing; and (vi) the first retainer and the second retainer are spaced apart from one another, thereby forming a gap, and the at least one movable plate is substantially contained within that gap; (c) wherein: the at least one movable plate is displaceable toward a second position that is proximal to the longitudinal axis, the displacement being caused by contact with the at least one ramp of the rotatable collar.

In accordance with another aspect, a method for attaching a power tool attachment to a power tool is provided, in which the method comprises the following steps: (a) providing a power tool having a front end portion, in which an exterior surface of the front end portion includes a protruding flange portion and a recessed channel portion that are proximal to one another; (b) providing a power tool attachment that includes an adapter portion used for mating against the front end portion of the power tool, the power tool attachment having a longitudinal axis that extends through the adapter portion, the adapter portion being proximal to an open end of the power tool attachment; (c) the adapter portion comprises: (i) a rotatable collar having a rounded exterior surface that is graspable by a human hand, the rotatable collar having a rounded interior portion that includes at least one ramp that protrudes inward at a non-uniform distance along an inner circumference of the rounded interior portion; (ii) at least one movable plate that is mounted within an interior volume of the rotatable collar, the at least one movable plate having a first surface that is sized and shaped to make physical contact with the at least one ramp of the rotatable collar, the at least one movable plate having a second surface that is sized and shaped to substantially fit into the recessed channel portion of the power tool front end; (iii) at least one biasing member for urging the movable plate toward a first position that is distal from the longitudinal axis; (iv) a first retainer that is mounted within the rounded interior portion of the rotatable collar, the first retainer being positioned proximal to a first side of the at least one movable plate, the first side being proximal to the open end of the power tool attachment; (v) a second retainer that is mounted within the rounded interior portion of the rotatable collar, the second retainer being positioned proximal to a second, opposite side of the at least one movable plate, the second side being more distal from the open end of the power tool attachment; (vi) the second retainer is mechanically coupled to the first retainer; and (vii) the first retainer and the second retainer are spaced apart from one another, thereby forming a gap, and the at least one movable plate is contained within that gap; (d) inserting the power tool front end onto the adapter portion of the attachment; and (e) rotating the rotatable collar, wherein: (i) the at least one ramp rotates with the rotatable collar; (ii) the non-uniform distance of the ramp forces the at least one movable plate to move inward, toward a second position; and (ii) when the at least one movable plate reaches the second position, it engages with the recessed channel portion of the power tool front end portion, thereby locking into position such that the power tool attachment becomes mounted to the power tool.

In accordance with yet another aspect, a power tool attachment is provided, which comprises: (a) an adapter, including: (i) a rotatable collar with an open interior circumference; (ii) at least one ramp on the interior circumference of the rotatable collar; (iii) at least one movable plate located within the interior circumference of the rotatable collar, the at least one movable plate including at least one spring to bias the at least one movable plate into a first position; (iv) a retaining end cap with an open interior circumference, proximal to the rotatable collar; (v) an inner retainer with an open interior circumference, located proximal to the rotatable collar, such that the at least one movable plate is contained between the inner retainer and the retaining end cap; and (vi) the inner retainer is mechanically coupled to the retaining end cap.

In accordance with still another aspect, a method for attaching a power tool attachment to a power tool is provided, the power tool exhibiting a protruding front end with a round tip interrupted by flat portions, and having at least one external flange, in which the method comprises the following steps: (a) inserting the power tool front end into an adapter portion of the attachment, the adapter comprising: (i) a rotatable collar with an open interior circumference; (ii) at least one ramp on the interior circumference of the rotatable collar; (iii) at least one movable plate located within the interior circumference of the rotatable collar, the at least one movable plate including at least one spring to bias the at least one movable plate toward a first position; (iv) a retaining end cap with an open interior circumference, located proximal to the rotatable collar; (v) an inner retainer with an open interior circumference, located proximal to the rotatable collar, such that the at least one movable plate is contained between the inner retainer and the retaining end cap; and (vi) the inner retainer is mechanically coupled to the retaining end cap; and (b) rotating the collar, wherein: (i) the at least one ramp rotates with the collar; (ii) the at least one ramp forces the at least one movable plate toward a second position; and (iii) the at least one movable plate engages behind the at least one external flange of the power tool, thereby mounting the attachment to the power tool.

Still other advantages will become apparent to those skilled in this art from the following description and drawings wherein there is described and shown a preferred embodiment in one of the best modes contemplated for carrying out the technology. As will be realized, the technology disclosed herein is capable of other different embodiments, and its several details are capable of modification in various, obvious aspects all without departing from its principles. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the technology disclosed herein, and together with the description and claims serve to explain the principles of the technology. In the drawings:

DETAILED DESCRIPTION

Figure 1:
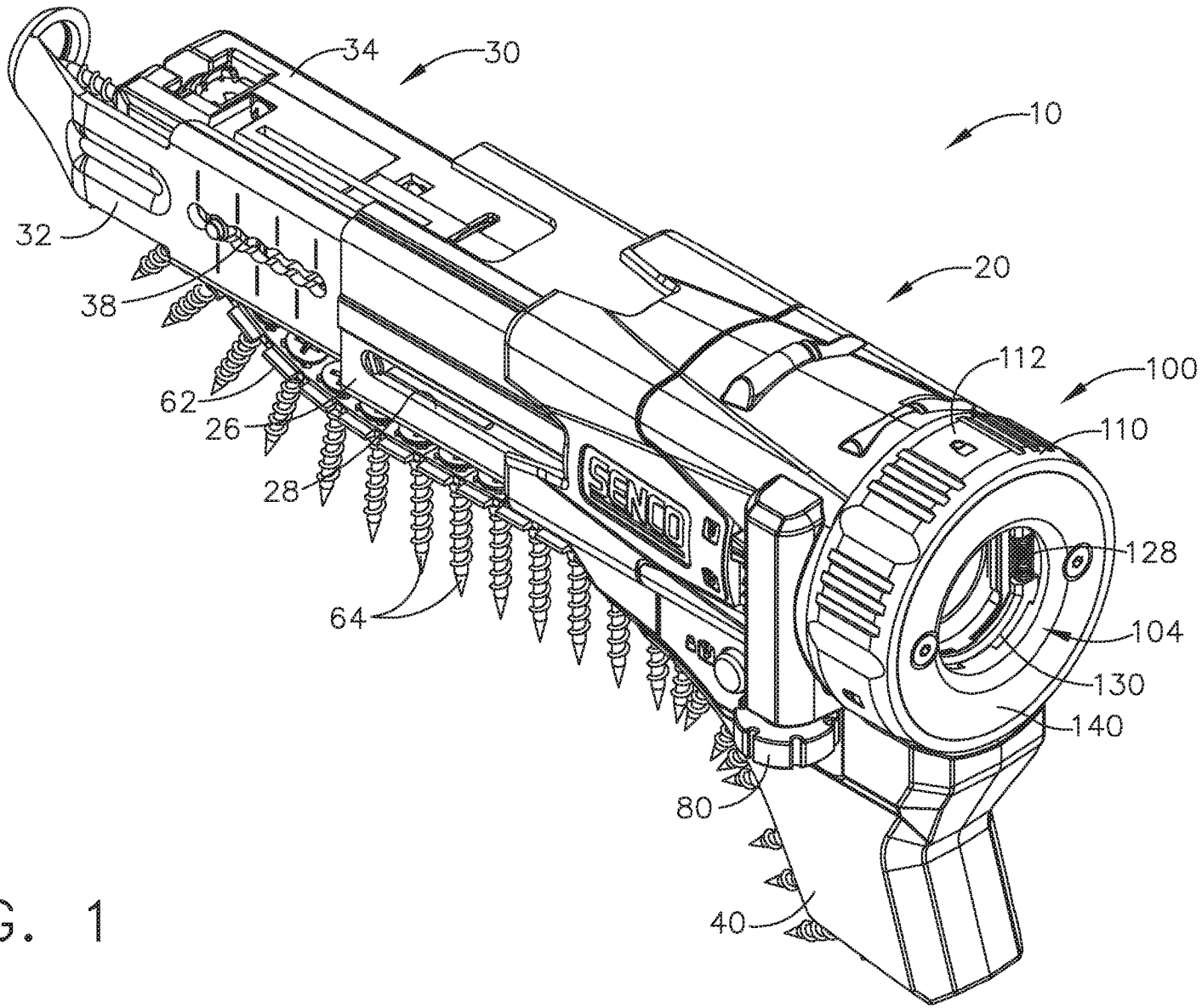
FIG. 1 is a perspective view of an autofeed screw gun attachment, as constructed according to the technology disclosed herein.

Reference will now be made in detail to the present preferred embodiment, an example of which is illustrated in the accompanying drawings, wherein like numerals indicate the same elements throughout the views.

It is to be understood that the technology disclosed herein is not limited in its application to the details of construction and the arrangement of components set forth in the following description or illustrated in the drawings. The technology disclosed herein is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," or "mounted," and variations thereof herein are used broadly and encompass direct and indirect connections, couplings, or mountings. In addition, the terms "connected" or "coupled" and variations thereof are not restricted to physical or mechanical connections or couplings. Furthermore, the terms "communicating with" or "in communications with" refer to two different physical or virtual elements that somehow pass signals or information between each other, whether that transfer of signals or information is direct or whether there are additional physical or virtual elements therebetween that are also involved in that passing of signals or information. Moreover, the term "in communication with" can also refer to a mechanical, hydraulic, or pneumatic system in which one end (a "first end") of the "communication" may be the "cause" of a certain impetus to occur (such as a mechanical movement, or a hydraulic or pneumatic change of state) and the other end (a "second end") of the "communication" may receive the "effect" of that movement/change of state, whether there are intermediate components between the "first end" and the "second end," or not. If a product has moving parts that rely on magnetic fields, or somehow detects a change in a magnetic field, or if data is passed from one electronic device to another by use of a magnetic field, then one could refer to those situations as items that are "in magnetic communication with" each other, in which one end of the "communication" may induce a magnetic field, and the other end may receive that magnetic field, and be acted on (or otherwise affected) by that magnetic field.

The terms "first" or "second" preceding an element name, e.g., first inlet, second inlet, etc., are used for identification purposes to distinguish between similar or related elements, results or concepts, and are not intended to necessarily imply order, nor are the terms "first" or "second" intended to preclude the inclusion of additional similar or related elements, results or concepts, unless otherwise indicated.

Referring now to the drawings, FIG. 1 shows a hand-held autofeed fastener driving tool attachment, generally designated by the reference numeral 10. Sometimes such an attachment assembly 10 is referred to merely as the "attachment," or sometimes referred to as the "tool" or the "attachment tool."

The attachment 10 mates to the front end of a manual-feed screw gun 2 by use of an adapter portion 100. Once the attachment 10 has been mounted to the screw gun 2, a collated strip of screws can be used with the screw gun 2, via this attachment 10. Attachment assembly 10 includes a housing portion 20, a front end portion 30, a feed guide portion 40, and a slide body subassembly portion 34. This combination creates an autofeed fastener driving tool system that is designed for use with a flexible strip of collated screws, and the flexible collated screw strip subassembly is generally designated by the reference numeral 60.

The housing portion 20 of the tool includes a front "feed housing" outer shell structure 22, which includes two housing halves 16 and 18. Housing portion 20 is also sometimes referred to herein as an "elongated housing." Toward the front of housing portion 20 is an elongated "feed tube" 26, which houses certain movable portions of the attachment 10, as discussed below. In the illustrated embodiment, the feed tube 26 is fixedly attached to the housing portion 20, and is also sometimes referred to herein as a "first member." It will be understood that feed tube 26 can be of any desirable cross-sectional shape while performing its functions (e.g., rectangular, square), and that it is substantially square in cross-section in the illustrated embodiments. The feed tube 26 has a longitudinal axis 102 that runs between a substantially open front end and a substantially open rear end, which are at opposite ends of the feed tube; a drive bit 66 fits through the rear end of the feed tube, and is substantially parallel to (or co-linear with) the longitudinal axis. The feed tube 26 is mainly hollow, that is, it has an interior volume that is mostly empty space, to allow the slide body subassembly 34 to move in and out of the front end of the feed tube.

The collated strip 60 subassembly slides through a curved feed guide 42 that is mounted to the lower surface of the housing 22. Attachment 10 includes an external depth of drive adjustment subassembly 80, and typically will have a depth of drive indicator (not numbered). The housing 22 thus exhibits a "mating end" near the adapter 100, which receives the front end (or nose portion) 3 of the screw gun 2.

The attachment's front end portion 30 includes a moveable nosepiece 32, which is attached to the slide body subassembly 34. Both the nosepiece 32 and slide body subassembly 34 are moveable in a longitudinal direction of the tool 10, and when the nosepiece 32 is pressed against a solid object, the autofeed attachment 10 will be actuated to physically drive one of the screws 64 into the solid object, also referred to herein as the "workpiece." Nosepiece 32 has a front surface 36, which preferably has a rough texture such as sandpaper, so that it will not easily slide while pressed against the surface of the workpiece when the tool is to be utilized.

In the illustrated embodiment of FIG. 1, the nosepiece 32 is detachable from the slide body subassembly 34 so that the nosepiece can be re-positioned for different lengths of fasteners, and then re-attached. The nosepiece 32 has a plurality of screw length positioning holes 38, which are used to attach nosepiece 32 to the slide body subassembly 34 at different relative positions to one another. The nosepiece is thus adjustably affixed (i.e., mounted) to the slide body subassembly. Slide body subassembly 34 is also sometimes referred to herein as an "elongated slide body." The nosepiece 32 also has a rear inclined edge, which works against another inclined surface that is part of a depth of drive subassembly 80. Nosepiece 32 is elongated, and has two opposite ends: a front end at 36 and a rear end at the inclined edge. As the tool is actuated (during a fastener driving event), nosepiece 32 has an axis of movement that is substantially parallel to the longitudinal axis of the feed tube 26.

The slide body subassembly 34 is movably "attached" to the feed tube 26, such that slide body subassembly 34 essentially slides along predetermined surfaces proximal to feed tube 26. In addition, an angled slot 28 is formed in feed tube 26 to provide a camming action surface (essentially a slotted opening having a curved portion and a straight portion) for a cam roller (or "cam follower") to traverse as the slide body subassembly 34 moves, relative to the feed tube 26. This action is used to cause the "next" fastener of the collated strip (see below) to index to a "firing position" (or "drive position"), by way of an indexing action of the slide body subassembly 34 (which indexing action is internal to the slide body subassembly).

The feed guide portion 40 includes a curved guide member 42 and an indexer input guide 44 that can each receive a flexible collated strip of fasteners, in this case the collated screw subassembly 60. The collated screw subassembly 60 mainly consists of a plastic strip 62 that has several openings to receive individual screws 64. The overall collated screw subassembly is flexible to a certain degree, as can be seen in the drawings by the curved orientation of the plastic strip 62 as it is fed through the slide body subassembly 34.

Some of the mechanical mechanisms described above for the portable fastener driving tool 10 have been available in the past from Senco Products, Inc. and Senco Brands, Inc., including such tools as the Senco Model Nos. DS162-14V and DS200-14V. These earlier tools utilized a fixed feed tube, a movable slide body, and nosepiece structure, without the "extended nose" feature of the technology disclosed herein. Some of the components used in the technology disclosed herein have been disclosed in commonly-assigned patents or patent applications, including a U.S. Pat. No. 5,988,026, titled SCREW FEED AND DRIVER FOR A SCREW DRIVING TOOL; a U.S. Pat. No. 7,032,482, titled TENSIONING DEVICE APPARATUS FOR A BOTTOM FEED SCREW DRIVING TOOL FOR USE WITH COLLATED SCREWS; a U.S. Pat. No. 7,082,857, titled SLIDING RAIL CONTAINMENT DEVICE FOR FLEXIBLE COLLATED SCREWS USED WITH A TOP FEED SCREW DRIVING TOOL; a U.S. Pat. No. 8,869,656, titled SCREWDRIVER TOOL WITH IMPROVED CORNER FIT FUNCTION; a U.S. Pat. No. 8,627,749, titled SCREWDRIVER TOOL WITH IMPROVED CORNER FIT FUNCTION; and a U.S. Pat. No. 8,726,765, titled SCREWDRIVER TOOL WITH IMPROVED LINEAR TRACKING. These patent properties have been assigned to Senco Brands, Inc., or to Kyocera Senco Industrial Tools, Inc., and their disclosures are incorporated herein by reference in their entireties.

The main purpose of attachment 10 is to drive rotatable fasteners (e.g., screws or bolts) that are provided in the form of the flexible collated strip subassembly 60. The individual screws 64 are held in place by a flexible plastic strip 62, and as the screws traverse through the guides 42 and 44, they are ultimately directed toward the front end portion of the tool 30 until each of the screws 64 reaches the "drive position." When viewing the tool 10 at its front-most portion, the left-most screw 64 has been indexed to the drive position, and thus is now essentially co-linear with the main drive components of the tool 10. As the collated screw subassembly 60 is moved through the input guide 44, the plastic strip 62 will eventually make contact with a sprocket that acts as a rotary indexer, and which is located inside the slide body subassembly 34. The sprocket moves each of the portions of the plastic strip 62 into a proper rotary position so that their attached screws 64 eventually end up in the front-most drive position. The sprocket is sometimes referred to herein as the "output member" of the slide body subassembly, which creates an indexing motion.

When the nosepiece 32 is actuated by being pressed against a workpiece, then a drive bit 66 will push the "lead" screw into the workpiece, and the drive bit 66 will also then be turned in a rotary motion to twist the lead screw in the normal manner for driving a screw 64 into a solid object. Once the lead screw has been successfully driven into the solid object, then the attachment 10 is withdrawn from the surface of the solid object, and of course the screw 64 remains behind and has now broken free from the plastic strip 62. In one mode of the technology disclosed herein, the attachment 10 will now be free to allow the sprocket to perform its rotary indexing function and to bring forth the next screw 64 into the front-most drive position. This type of screw-feed actuation can be referred to as "indexed on return," since the "lead screw" is moved into the "firing position" as the nosepiece 32 is released (or "returned") from the surface of the workpiece.

The tool 10 can also be configured in an alternative screw-feed actuation mode, in which the lead screw is moved into the firing position as the nosepiece 32 is pressed against the surface of a workpiece; this type of screw-feed actuation can be referred to as "indexed on advance." If tool 10 is configured for indexed on advance, then the lead screw would not yet be in the firing position at the moment the nosepiece 32 is "relaxed" or "free," in its non-firing state. Instead, the lead screw would not be indexed into the firing position until the nosepiece 32 is "pushed in" (or "advanced") toward the main body portion of the attachment 10 (e.g., toward the adaptor 100). Alternatively, if tool 10 is configured for "indexed on return," then the lead screw would already be in the firing position at the moment the nosepiece 32 is "relaxed" or "free," in its non-firing state (unless the tool had not yet been properly loaded with a new collated strip of screws, for example). Note that the "indexed on return" configuration is a preferred mode of operation for tool 10. It will be understood that both the "indexed on advance" and "indexed on return" screw-feed actuation modes of operation can work with the technology disclosed herein.

Figure 7:
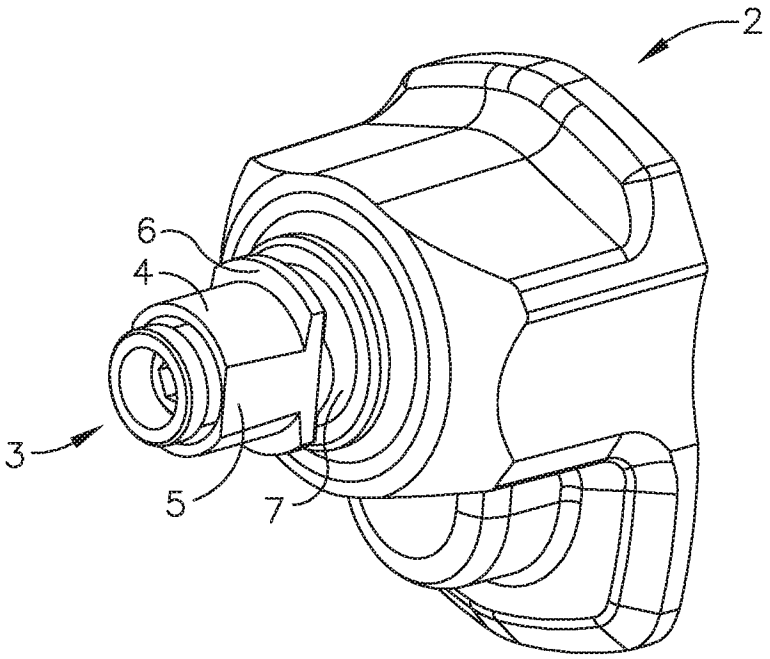
FIG. 7 (PRIOR ART)
FIG. 7 is a perspective view of a front end of a prior art manual-feed screw gun.
Figure 6:
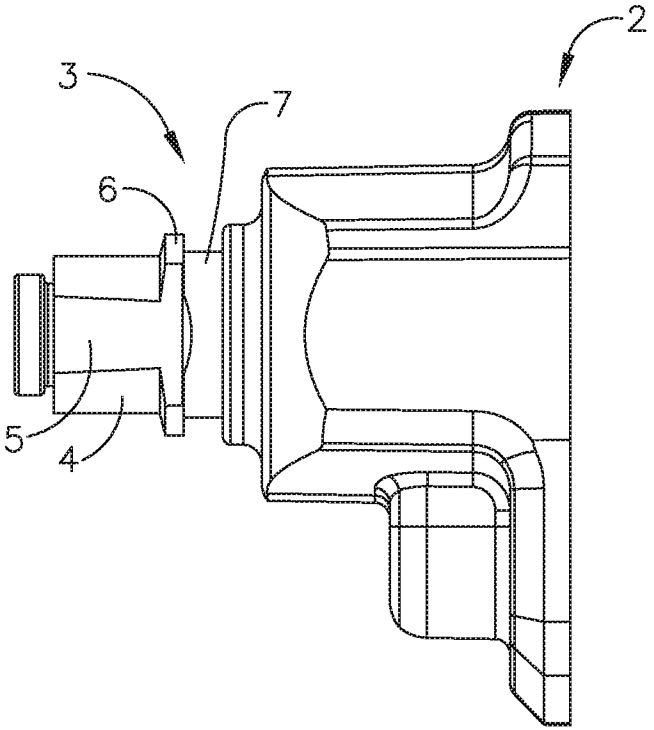
FIG. 6 (PRIOR ART)
FIG. 6 is a side elevational view of a front end of a prior art manual-feed screw gun.

At the rear end portion of the attachment 10 is an adapter portion, generally depicted by the reference numeral 100. This adapter 100 is made to fit on a DeWalt DCF620 single-faced screwdriver, onto the front nose piece portion 3 that was illustrated in FIGS. 6 and 7. The adapter portion 100 includes a rotatable collar 110, which has a rounded exterior surface 112. The adapter also includes an open end at 104 that fits over the nose portion of the DeWalt tool.

Figure 2:
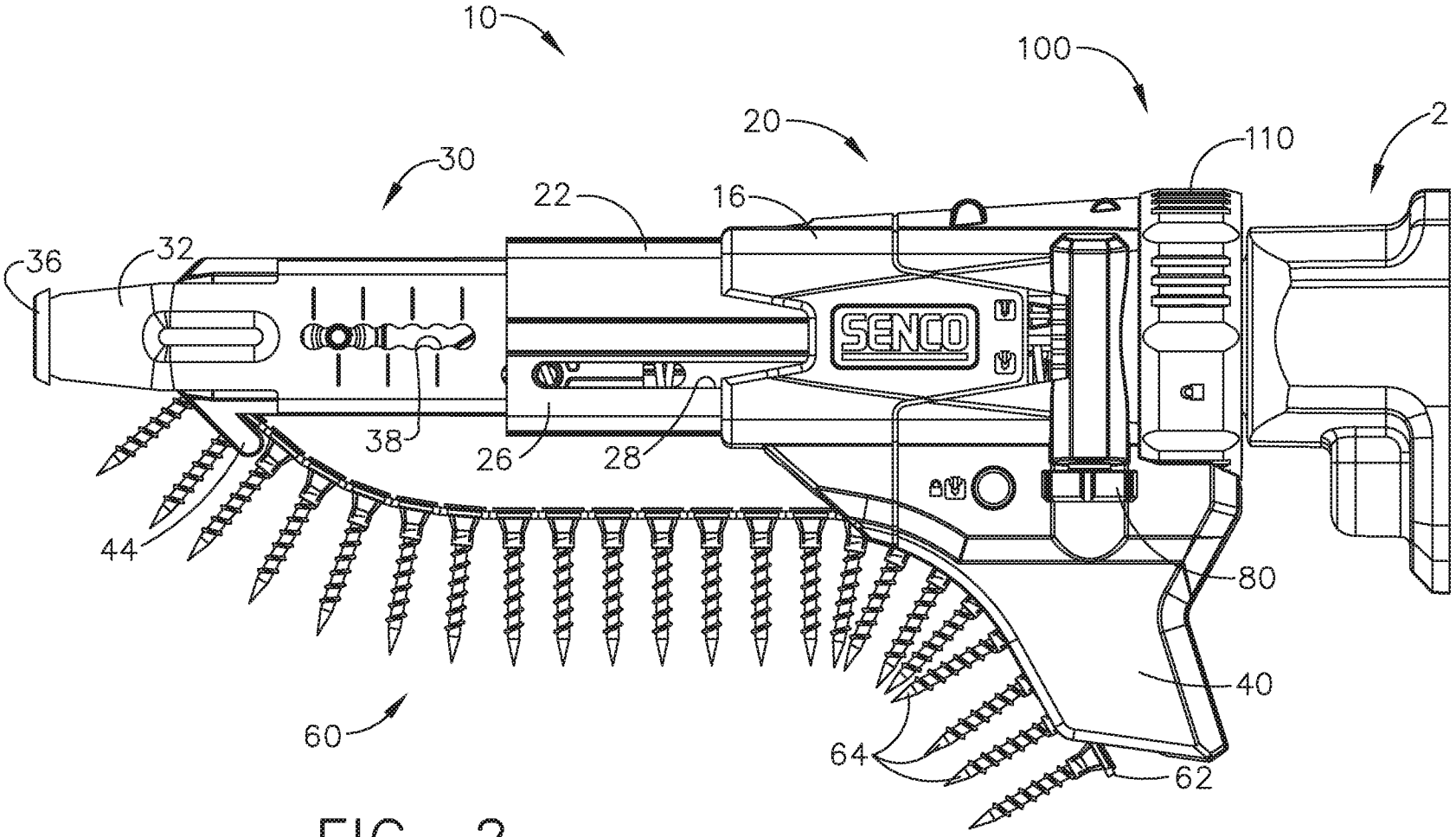
FIG. 2 is a side elevational view of the autofeed screw gun attachment of FIG. 1, depicted in its non-actuated state, and mounted to a conventional manual-feed screw gun.
Figure 3:
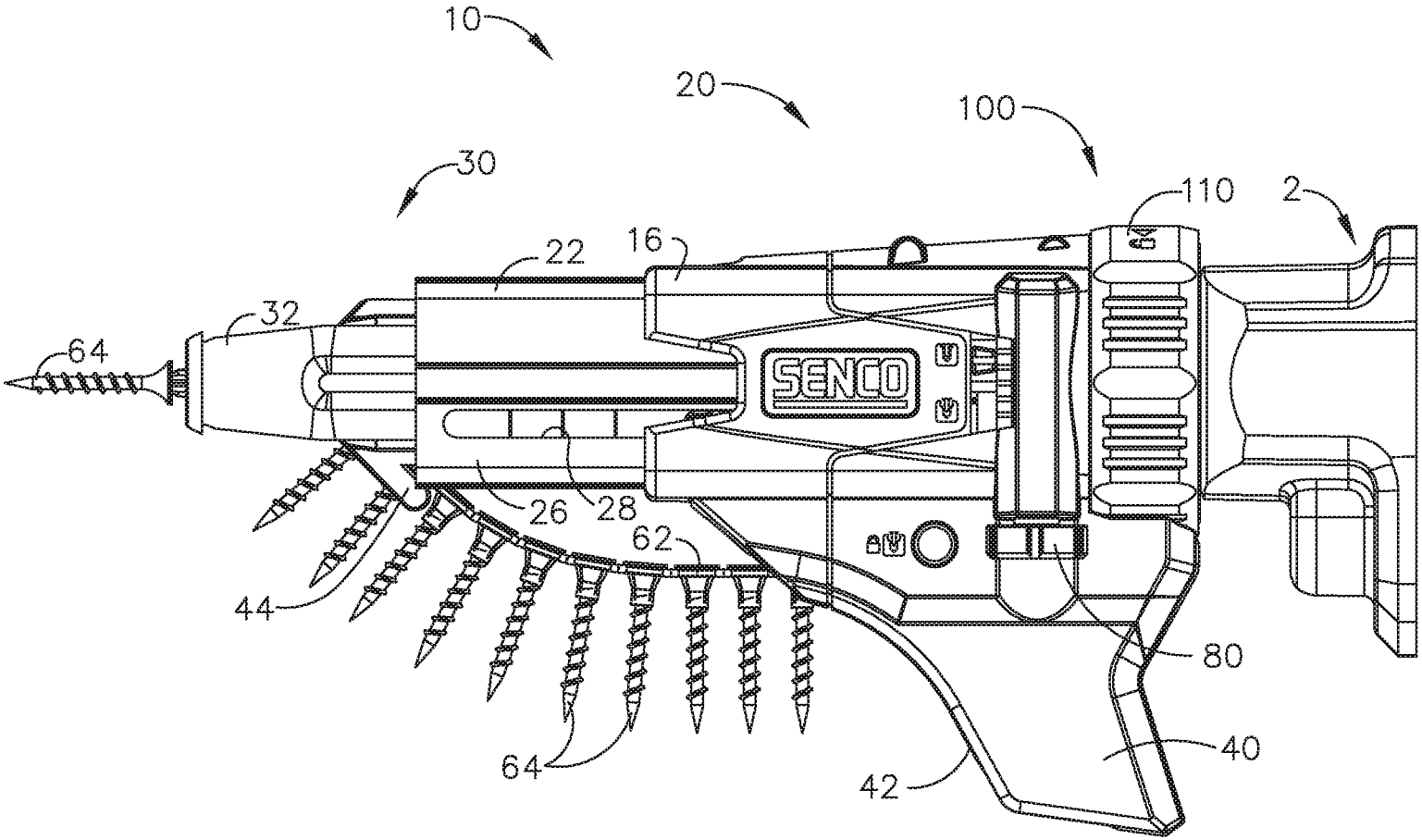
FIG. 3 is a side elevational view of the attachment of FIG. 2, shown in its actuated state, in which it would be driving a screw into a workpiece.

FIGS. 2 and 3 also show the autofeed attachment 10 as it would be mounted onto a DeWalt tool that is depicted by the reference numeral 2. In FIG. 2, the autofeed attachment 10 has its slidable nose portion fully extended, which is the appearance it would have when it was not being pressed against a workpiece. In FIG. 3, the slidable nose portion has been fully collapsed into the feed tube or "feed housing" 22, which is the appearance this tool would have when the device was driving a screw all the way into a workpiece.

Figure 4:
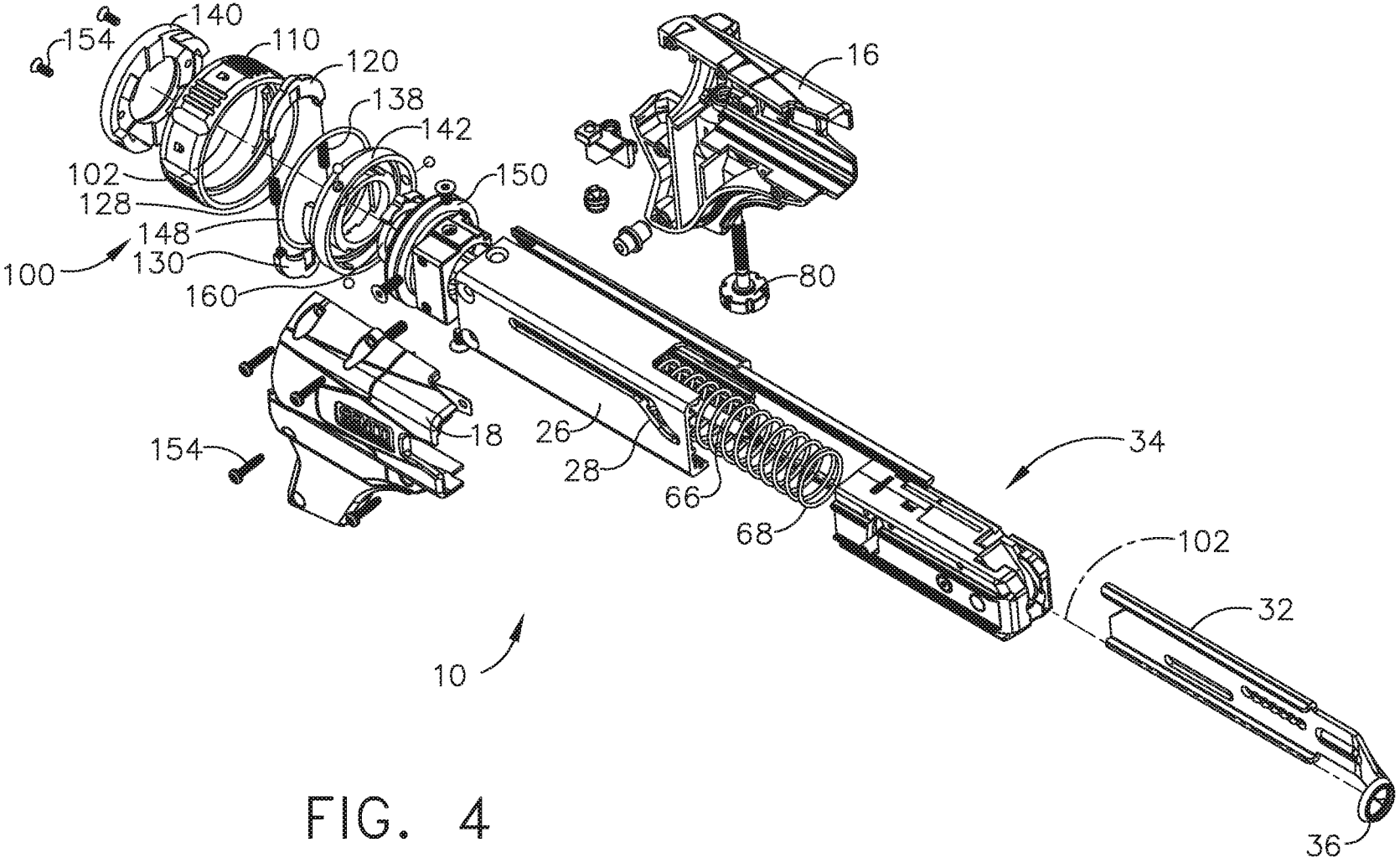
FIG. 4 is an exploded view of the autofeed screw gun attachment of FIG. 1.

Referring now to FIG. 4, an exploded view of the entire attachment 10 is provided, showing some of the main components. The slide body subassembly 34 includes many interior parts that are not shown in detail in this view, but it will be understood that it includes an indexing mechanism that indexes the collated strip of screws to the next position when it is time to drive a new screw. Other internal components can be seen in this view, such as a drive bit 66 and a return spring 68 that pushes the slide body back to its extended position after a driving event has occurred. The main housing can be seen as comprising two half-housings; the left half-housing is depicted at reference numeral 16, while the right half-housing is depicted at reference numeral 18. The housing halves are held together by a set of fasteners 154.

FIG. 4 shows some of the major components of the adapter portion 100. The rotatable collar 110 can be seen, and a longitudinal axis 102 is depicted on FIG. 4, which extends all the way through the attachment, essentially along its centerline of the rotatable collar 110. It will be understood that a single longitudinal axis is not entirely necessary to construct this type of attachment device; in other words, the centerline of the rotatable collar 110 does not necessarily have to match up to the centerline of the screw exit position through the nosepiece front portion 36 (although if those two center-lines are not co-linear, they typically would be parallel to one another in this type of tool).

Some of the other major components seen on FIG. 4 include a first movable plate 120, a second movable plate 130, and a pair of coil springs 128 and 138 that are fitted between the two movable plates 120 and 130, when this is constructed as a subassembly. Also illustrated are a first retainer 140, a second retainer 142, an indexer 150, a first O-ring 148, and a second O-ring 160.

Figure 5:
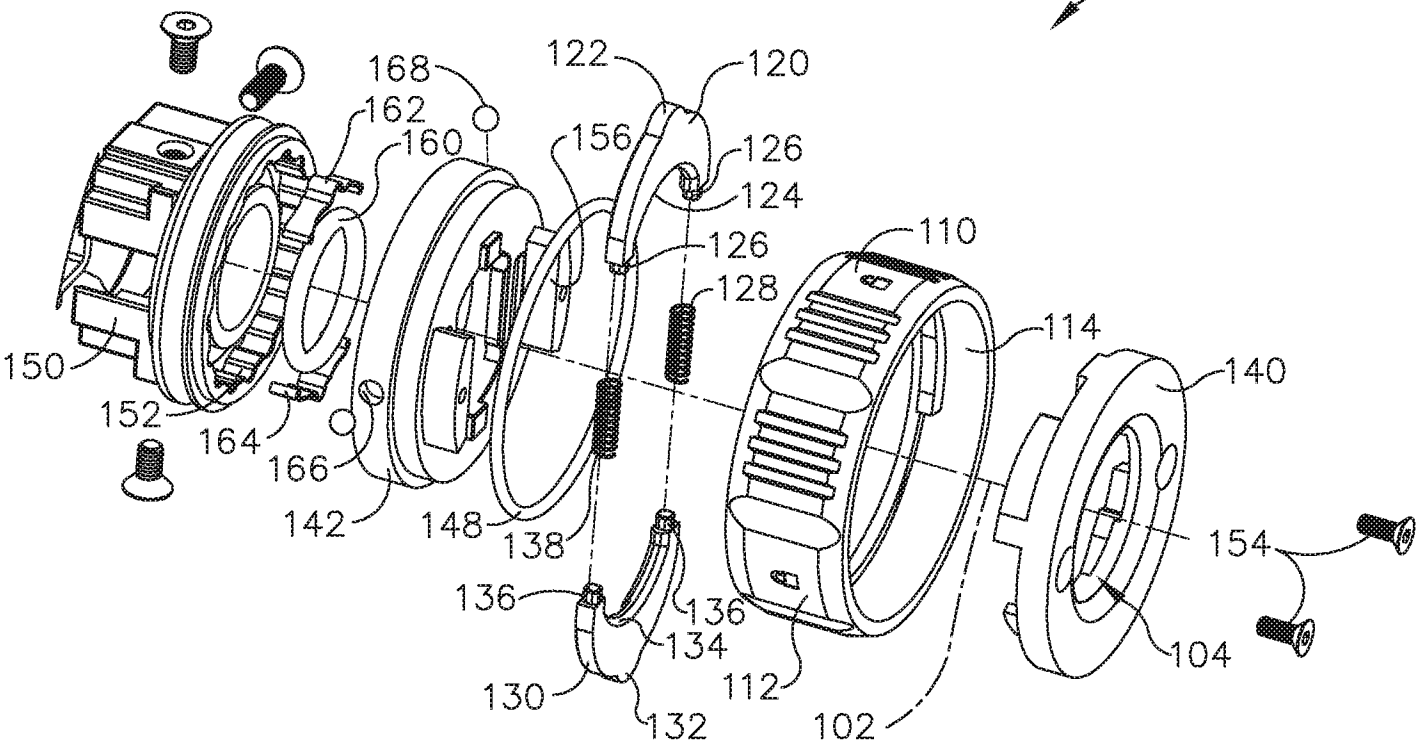
FIG. 5 is an exploded view of an adaptor portion of the attachment of FIG. 1.

Referring now to FIG. 5, the adapter portion 100 of the autofeed attachment 10 is illustrated in greater detail in an enlarged, exploded view. The rear-most piece of this adapter is referred to as a "first retainer" at reference numeral 140, which has an open area 104 which also is the open end of the power tool attachment 10. Extending toward the left (in this view of FIG. 5) is the longitudinal axis 102 of this portion of the adapter 100. A set of fasteners 154 holds the first retainer 140 to a second retainer 142. The first retainer 140 is also sometimes referred to as a "restraining cap" or a "retaining end cap" because it holds most of the pieces together (along with the fasteners 154) of this adapter portion 100.

The rotatable collar 110 encloses the adapter portion first retainer 140, when these pieces are formed into a fully-assembled subassembly that comprises adapter 100. The collar 110 includes a rounded outer or exterior surface at 112, and also includes a rounded interior surface at 114, in which that rounded interior surface has an inner circumference from which certain other structures protrude. There are two ramp structures 116 and 118 that protrude from the interior surface 114, but they are better viewed on other drawings, such as FIGS. 15 and 16.

There are two movable plates 120 and 130 that also fit inside the rotatable collar 110. The first movable plate 120 is the "top" plate in this view, and it has a first contact surface 122 that, under certain circumstances, contacts the ramp 116. The second movable plate 130 is the "bottom" plate in this view, and it also includes a first contact surface 132, and under certain circumstances this first contact surface 132 contacts the ramp 118. The top movable plate 120 also includes a second contact surface 124 that, under certain circumstances, will contact the recess channel 7 of a DeWalt tool front end 3, when this attachment 10 is mounted to a DeWalt tool. Similarly, the bottom plate 130 includes a second contact surface 134 that also contacts (the bottom-portion of) the recessed channel 7 of a DeWalt tool front end 3, when the attachment 10 is mounted to a DeWalt tool.

The top plate 120 includes a pair of spring posts 126, which extend toward the second or bottom movable plate 130. Similarly, the bottom movable plate 130 includes a pair of spring posts 136 that extend toward the first or top movable plate 120. A pair of coil springs are assembled to these spring mounting posts, in which the "right" coil spring is depicted at 128, and the "left" coil spring is depicted at 138. These two springs 128 and 138 tend to push the two movable plates 120 and 130 away from one another at times when they are not being forced toward one another (i.e., toward making contact with a recessed channel of a DeWalt tool). It will be understood that the springs 128 and 138 are "biasing members," in that they bias the two plates 120 and 130 away from each other, and that other types of biasing members could be used instead of coil springs to perform that function, but still within the teachings of this technical disclosure.

The second retainer 142 is also sometimes referred to as an "inner retainer" or a "rotating adapter," which also works with an indexer 150. This second retainer 142 includes some detent openings at 166, and, as seen in the figures, there are three detent balls 168 that are spaced around the outer circumference of the second retainer 142 which help to hold the indexer 150 and the second retainer 142 into one of the notches 152 that are found in the indexer 150. Other parts that work with this rotatable indexing scheme are a second O-ring 160, and two leaf springs 162 and 164. All of these parts help to provide a positive feel and help to provide an interference fit and to act as a compression component within the indexing ring portion of the indexer 150.

The first and second movable plates 120 and 130 are held in a space 144 between the two retainers 140 and 142. The first O-ring 148 is also provided in a nearby space area, which smoothes the motion when the rotatable collar 110 is actuated by a human user, and adds some resistance to the collar rotation to give a more positive feel as the attachment 100 is mounted.

The second retainer 142 also includes a pair of planar surfaces 156 (see FIG. 5). These surfaces 156 are designed to make contact against the relatively flat surfaces 5 on the nose portion 3 of a DeWalt tool, once the attachment 10 is mounted to such a DeWalt tool. These planar surfaces 156 prevent the interior portion of the adapter 100 from being rotated, as the rotatable collar 110 is manually rotated by a user.

Figure 8:
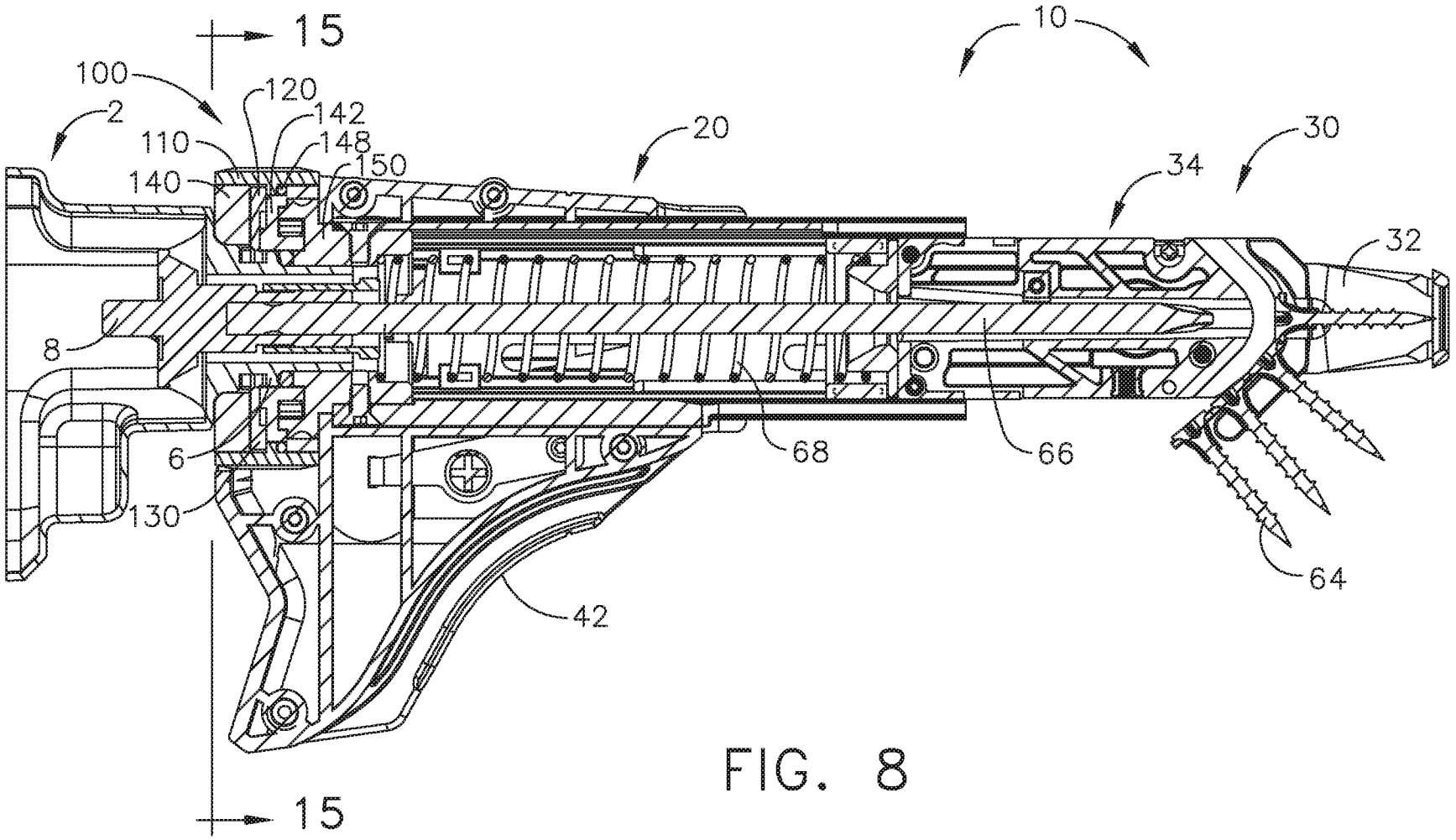
FIG. 8 is a cross-section elevational view of the autofeed screw gun attachment of FIG. 1.

Referring now to FIG. 8, the attachment 10 is depicted in an elevational cutaway view, and shows portions of a DeWalt DCF620 tool, generally depicted at the reference numeral 2. The DeWalt tool has a chuck 8 that holds a drive bit 66. Normally when an attachment is provided for a single-feed screwdriver tool, the attachment comes with a drive bit that is specifically made to fit into that single-feed driving tool, but a different drive bit that will operate with the attachment can be installed in the chuck, instead. Such is the case with the drive bit 66.

FIG. 8 also shows the protruding flange 6 that is on the exterior surface of the screw gun 2, and shows the first movable plate 120 and the second movable plate 130 in close proximity to that protruding flange 6. The first and second retainers 140 and 142 are illustrated, mainly as surrounding the first and second movable plates 120 and 130. Some of the interior parts are illustrated in greater detail in FIGS. 10 and 11, herein.

Figure 9:
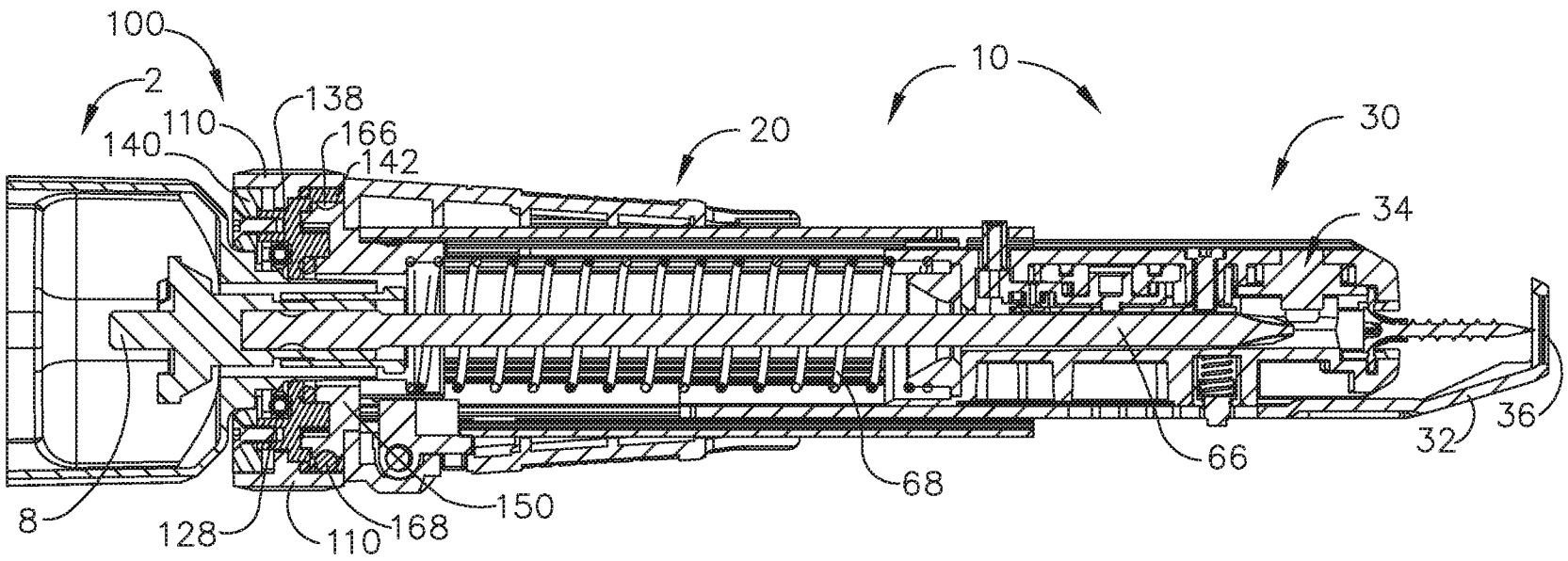
FIG. 9 is a top cutaway plan view of the autofeed screw gun tool of FIG. 1.

Referring now to FIG. 9, the attachment 10 is illustrated in a top plan cutaway view, and shows a portion of a DeWalt DCF620 screw gun at the reference numeral 2. This part of the DeWalt tool includes a chuck 8 that holds the drive bit 66. FIG. 9 illustrates the first retainer 140 and the rotatable collar 110. The two coil springs between the first and second movable plates are illustrated, in which the "left" coil spring is at 138 and the "right" coil spring is at 128. The second retainer 142 is illustrated, along with one of the rounded detents 166 (on the top portion of this view) and one of the detent balls 168 (at the bottom portion of this view).

Figure 10:
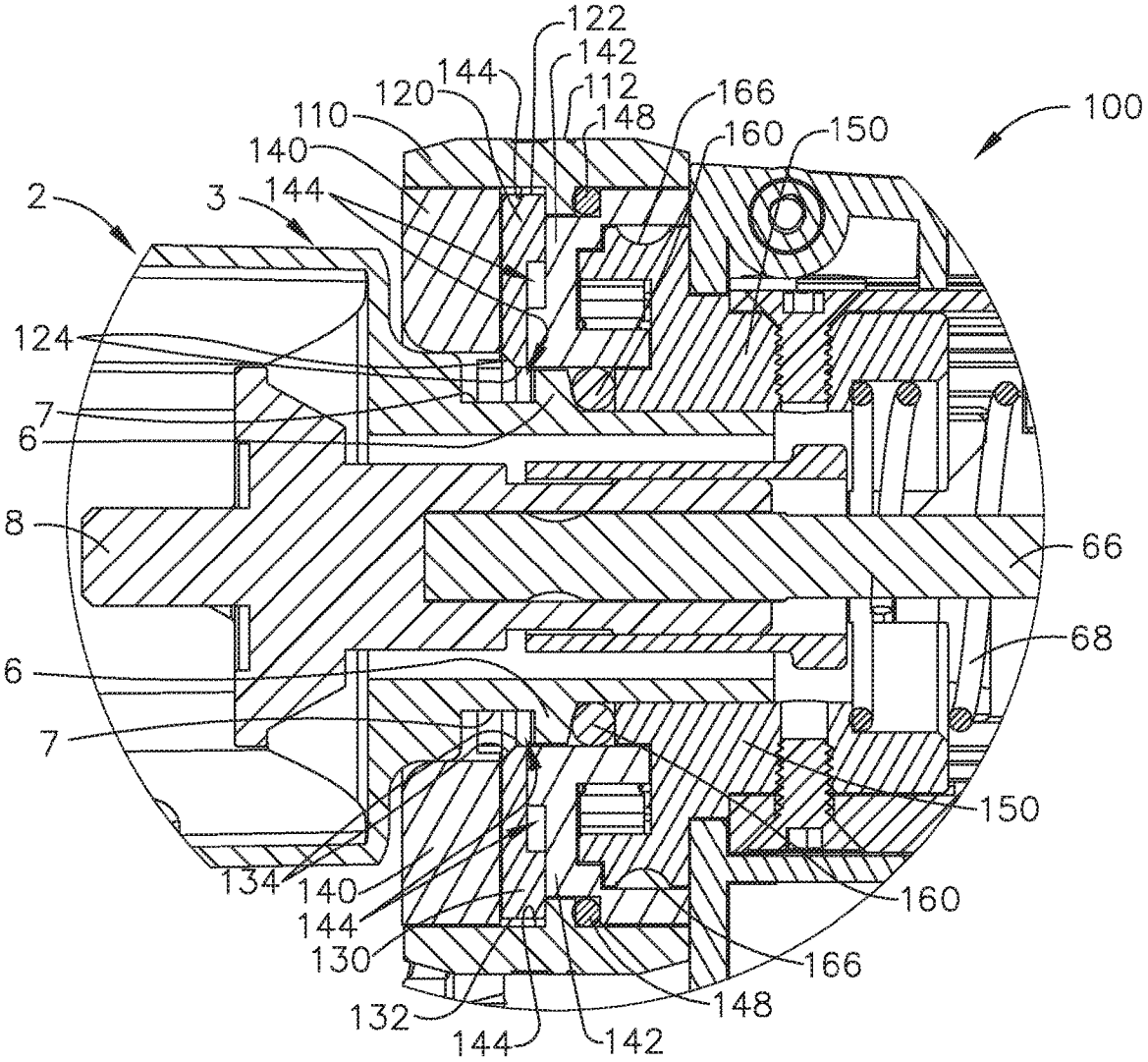
FIG. 10 is an enlarged cutaway view from the side of the adapter portion of the attachment of FIG. 1, showing its movable plates in a non-locking position.

Referring now to FIG. 10, an enlarged view of some of the inner mechanisms is provided, in this case showing the adapter as being positioned over the nose portion 3 of a DeWalt screw gun 2, in this view, the rotatable collar 110 has not yet been actuated, and therefore, the first and second movable plates 120 and 130 are not yet in a "locking" position. In FIG. 10, the protruding flange 6 is depicted in "X-shaped" cross-hatching, and this is part of the outer surface of the front portion 3 of the screw gun 2. FIG. 10 also shows the recessed channel 7 on the screw gun, which is positioned proximal to the protruding flange 6.

After the attachment 100 has been placed over the front nose portion of the DeWalt tool, as seen in this view of FIG. 10, the first retainer 140 becomes positioned against one of these surfaces of the front nose portion 3 of the DeWalt screw gun 2. The second retainer 142 becomes positioned in a near friction fit against the outer edge portion of the protruding flange 6 of the screw gun 2. The relatively large second O-ring 160 circles around the angled surface of the protruding flange 6, and that O-ring 160 is held in place by the second retainer 142 and by the indexer 150. The top and bottom movable plates 120 and 130 are held in place between the two retainers 140 and 142, and there is a small space 144 between the retainers that allows for vertical (in this view) movement of these two plates 120 and 130. The first O-ring 148 is held in place between the outer rotatable collar 110 and the second retainer 142.

In FIG. 10, the first contact surface 122 of the "top" plate 120 can be seen, and also the second contact surface 124 of that same plate 120 is visible. At this configuration, the second contact surface is not touching anything, and it is within the small interior space 144. In a similar manner, the first contact surface 132 of the "bottom" movable plate 130 is illustrated and so is the second contact surface 134 of that same plate 130. At this configuration, the second contact surface 134 is not touching anything, except for the small interior space 144. It will be understood that, in the configuration of FIG. 10, the rotatable collar 110 has a pair of ramps that are not seen in this view, and at this orientation, those ramps are not attempting to push the first and second movable plates 120 and 130 toward the center interior portions of the mechanism. When a human user rotates the collar 110 so as to "lock" the attachment 10 onto the DeWalt tool, then these orientations will change significantly, as seen on FIG. 11.

Figure 11:
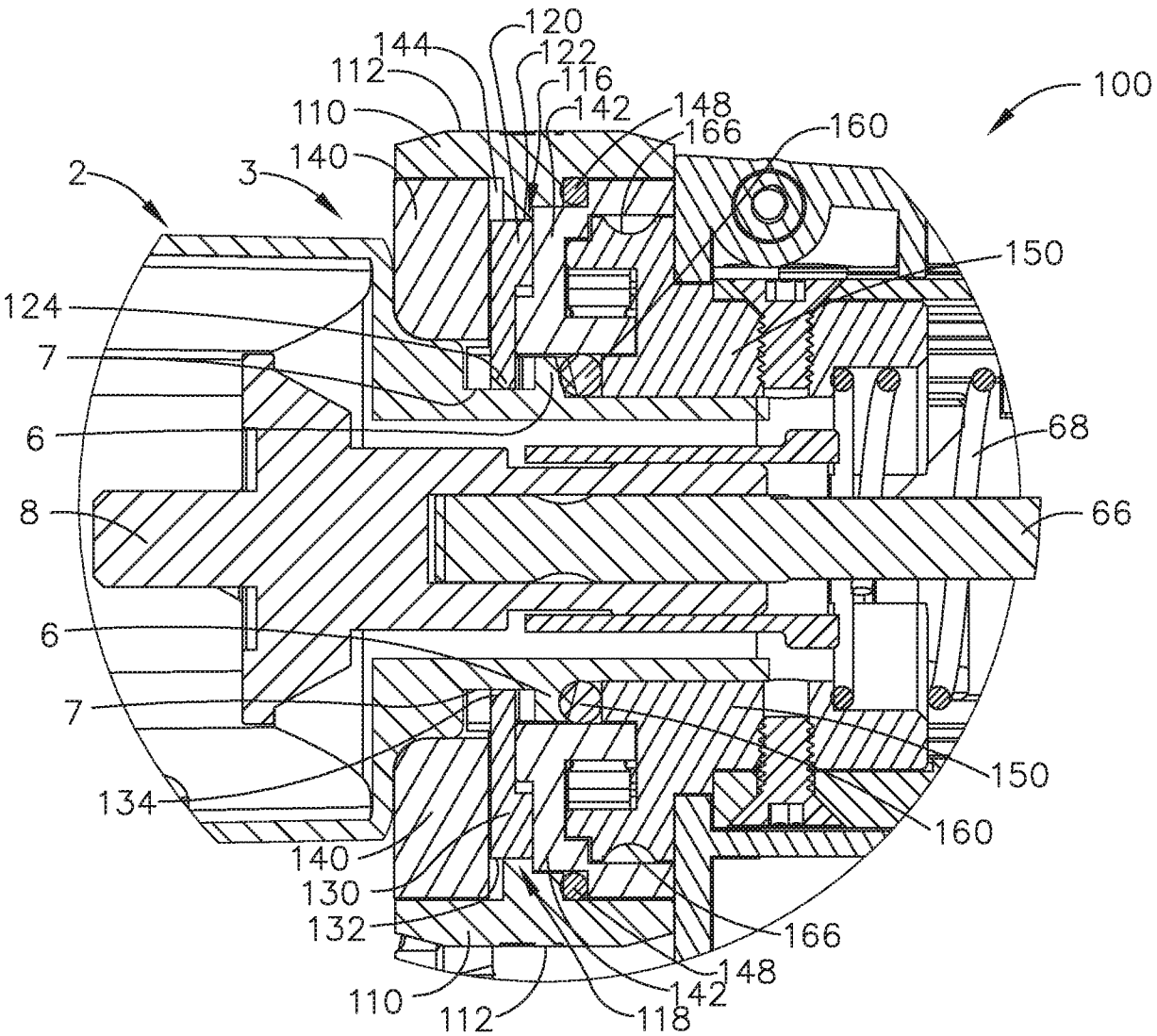
FIG. 11 is an enlarged cutaway view from the side of the adapter portion of the attachment of FIG. 1, showing its movable plates in a locking position.

Referring now to FIG. 11, most of the same structures that were visible in FIG. 10 are again visible, except that the rotatable collar 110 has been moved in which its gripping outer surface 112 is actuated by use of a human user's hand. That rotation causes the first ramp 116 to press down against the first (top) movable plate 120, which forces that movable plate to move directly downward in a vertical direction (in this view of FIG. 11) until its second contact surface 124 is pressed against the recessed channel 7 on the DeWalt screw gun. In a similar manner, the second ramp 118 has also been rotated and, therefore, it pushes against the second (bottom) movable plate 130 and forces it upward in a vertical direction (in this view of FIG. 11), until the second contact surface 134 is pressed against the recessed channel 7 on the screw gun. When this rotatable collar action occurs, the two movable plates 120 and 130 become "locking" structures, since they become essentially press-fit against the recessed channel 7 of the DeWalt tool, and since these plates are "behind" the flange portions 6 of that DeWalt tool. Furthermore, the second O-ring 160 becomes press-fit against the opposite side of the protruding flange 6 of the DeWalt tool, and that O-ring smoothes the motion and adds resistance to the collar rotation, and aids in keeping the adapter portion 100 locked onto the outer surfaces of the DeWalt tool's front end 3.

Figure 12:
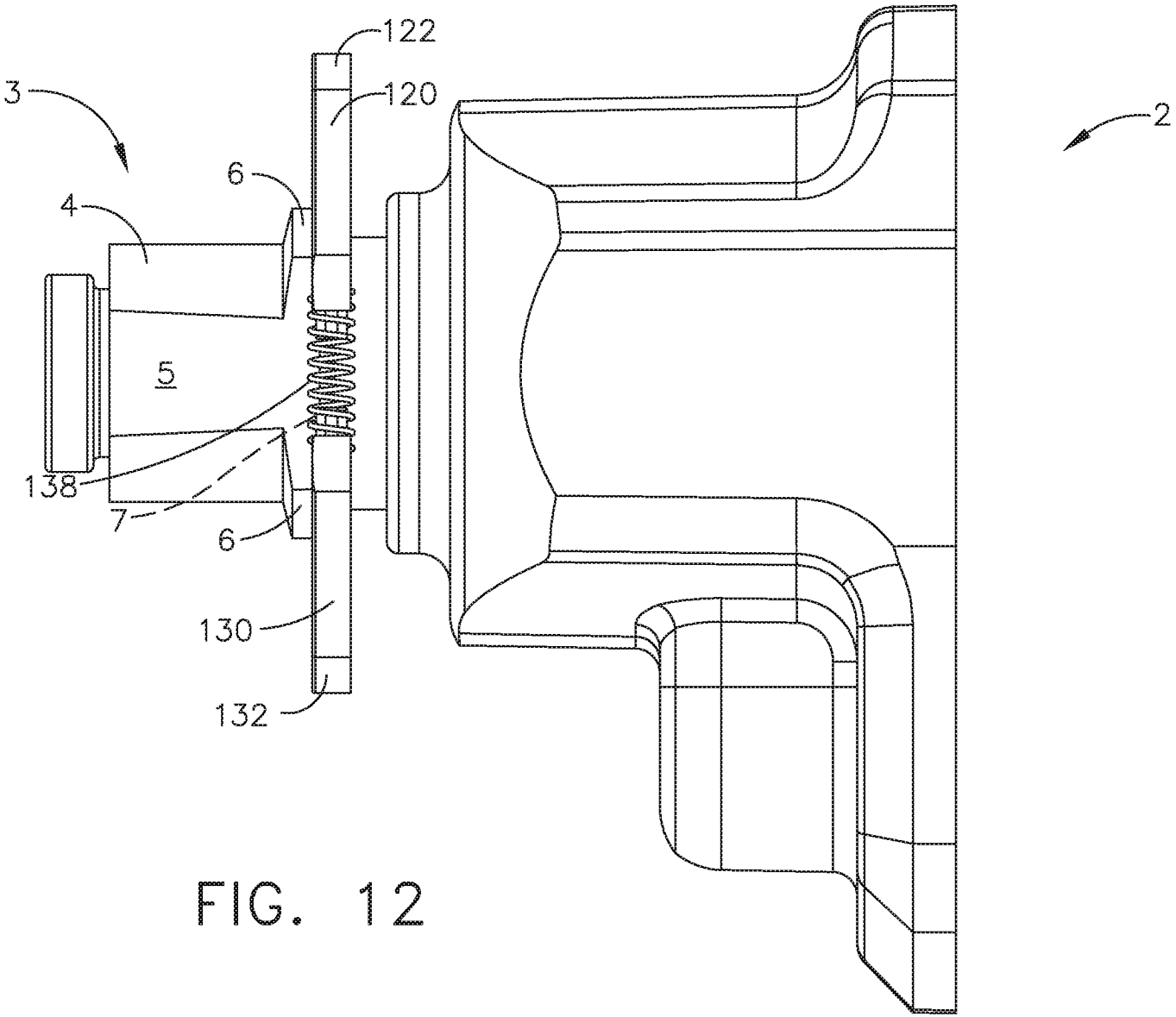
FIG. 12 is a side elevational view of a front end of a conventional manual-feed screw gun, showing a position of the movable plates of the adapter portion of the attachment of FIG. 1.

Referring now to FIG. 12, the DeWalt tools' front end 3 is depicted with the two movable plates 120 and 130 shown in a position where they are about to lock in place. In FIG. 12, the left coil spring 138 is illustrated in its extended or non-compressed state, and it is positioned over the spring posts 126 and 136 of the plates 120 and 130, respectively.

Figure 13:
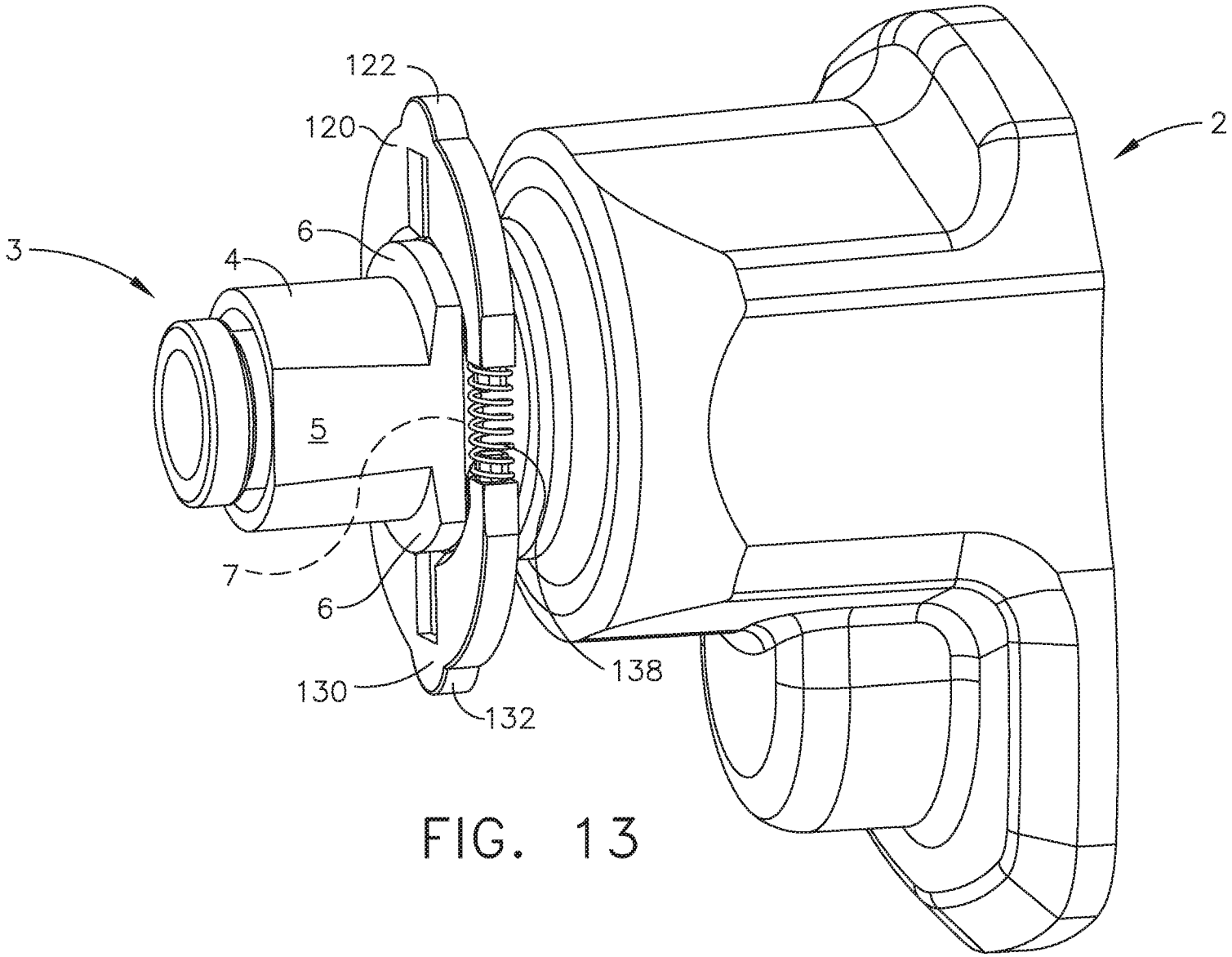
FIG. 13 is a perspective view mainly from the side showing a front end of a conventional manual-feed screw gun showing the movable plates of the adapter portion of the attachment of FIG. 1, in which the movable plates are in a non-locking position.

Referring now to FIG. 13, the same configuration as was illustrated in FIG. 12 is depicted here, showing this in a perspective view so that one can more easily see the relationship between the movable plates 120 and 130 and the protruding flange 6 on the screw gun 2. When the adapter portion 100 of the attachment 10 is first placed over the front portion 3 of the DeWalt tool, this is the orientation that would occur between the first and second movable plates 120 and 130 and that protruding flange 6. The other components of the adapter portion 100 are not shown in this view.

Figure 14:
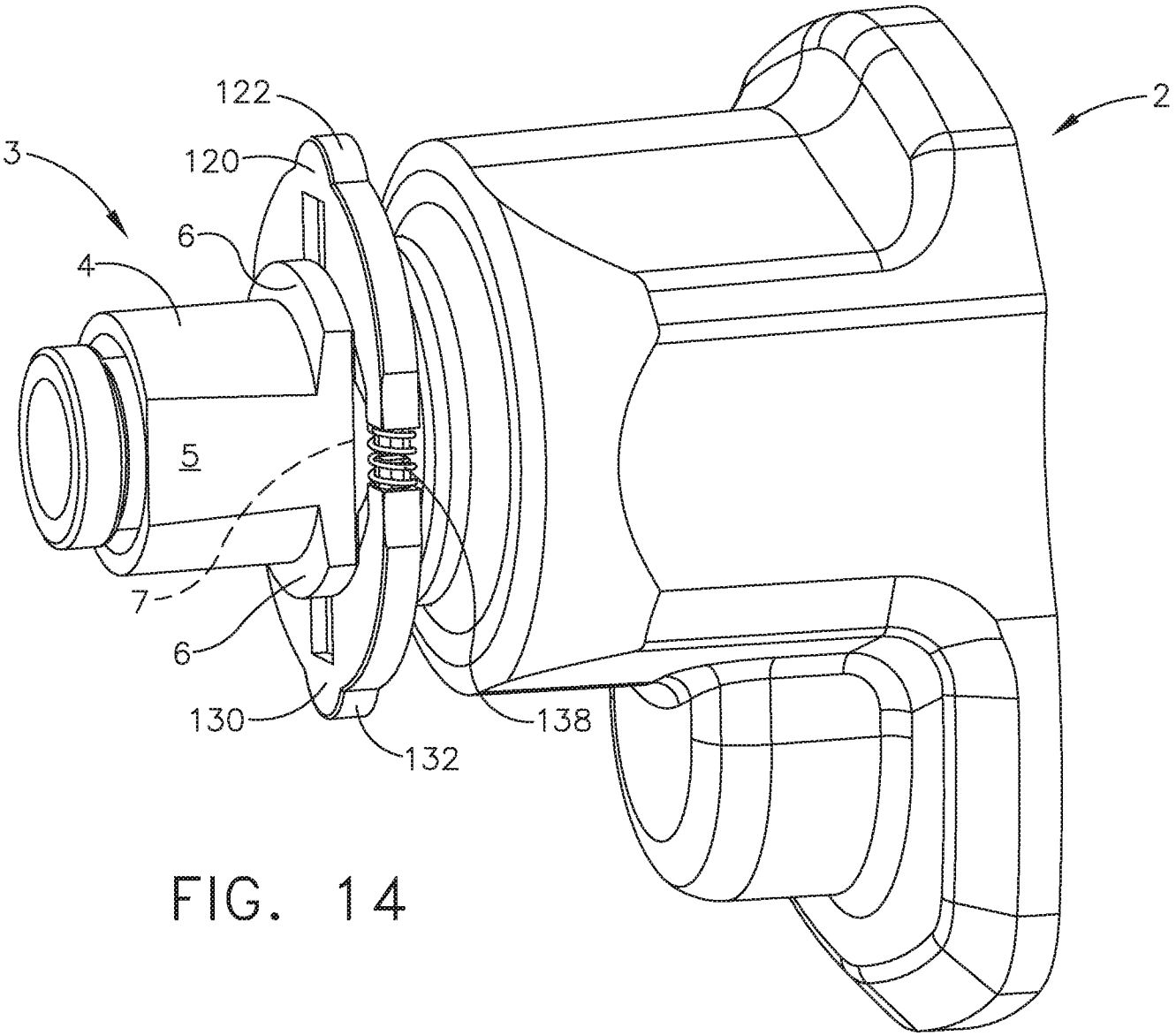
FIG. 14 is a perspective view mainly from the side showing a front end of a conventional manual-feed screw gun showing the movable plates of the adapter portion of the attachment of FIG. 1, in which the movable plates are in a locking position.

Referring now to FIG. 14, the same components as were seen in FIG. 13 are again illustrated in this view, except now the top and bottom movable plates 120 and 130 have been forced together (i.e., toward one another, into a position that is more proximal to the centerline or longitudinal axis 102), and the coil spring 138 has been compressed. In this view, it can be seen that the two movable plates 120 and 130 are now positioned behind the protruding flange 6 of the DeWalt tool front end 3, and so they are now in their locking orientation.

Figure 15:
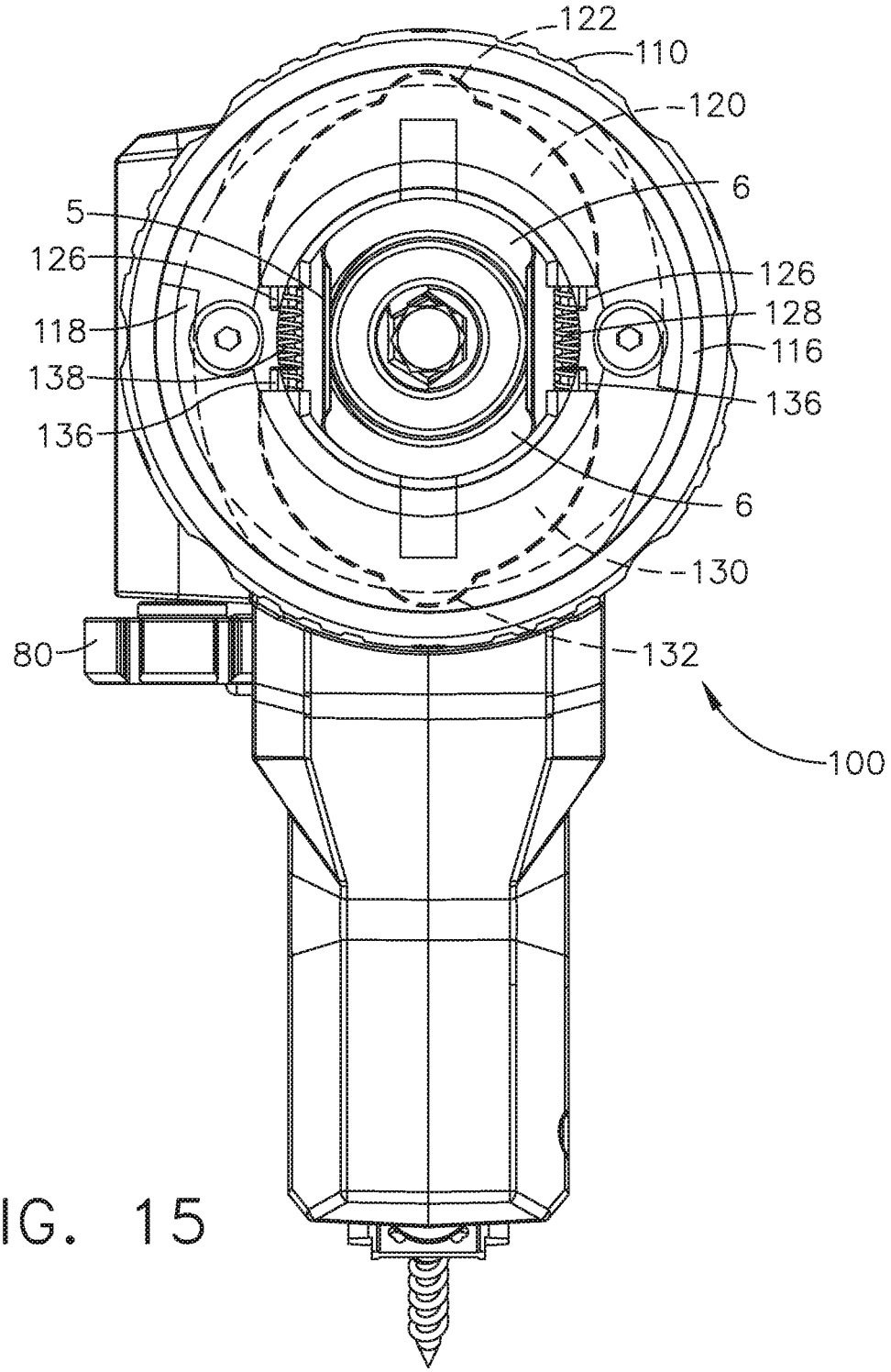
FIG. 15 is a cutaway view along the section line 15-15 depicted on FIG. 8, showing the movable plates in a non-locking position.

Referring now to FIG. 15, the attachment is depicted in an elevational view down the longitudinal axis (or centerline), which also shows some portions of the DeWalt tool front end. This essentially would be a cutaway view through the section line 15-15 on FIG. 8, but with the addition of the (hidden) first and second movable plates 120 and 130, as well as the (hidden) first and second ramps 116 and 118. In FIG. 15, the collar 110 has not been rotated, and therefore, the ramps 116 and 118 have their most protruding portions at about the 3:00 and 9:00 positions. In this configuration, the ramps are not pressing down against the first contact surfaces 122 and 132 of the movable plates 120 and 130, respectively. In this configuration, the movable plates 120 and 130 are in their distal position with respect to the centerline or longitudinal axis 102.

Figure 16:
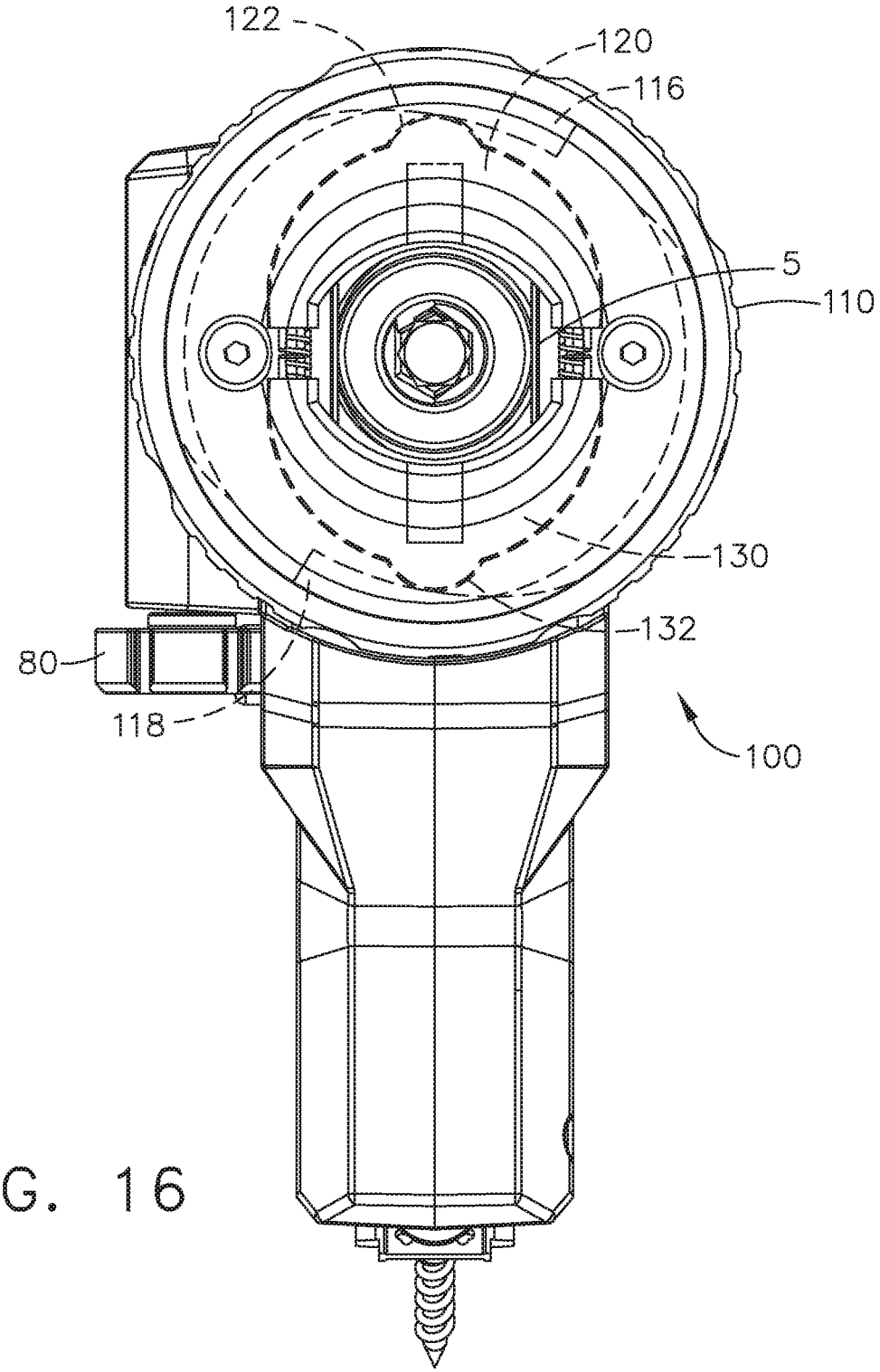
FIG. 16 is a cutaway view along the section line 15-15 depicted on FIG. 8, showing the movable plates in a locking position.

Referring now to FIG. 16, which is the same type of view as FIG. 15, also taken along the same section line on FIG. 8. In this configuration, the collar 110 has been rotated approximately 90 degrees, and therefore the ramp 116 has been moved up to about the 1:00 position for its most protruding surface, and the bottom ramp 118 has been moved to about the 7:00 position for its most protruding portion. As can be seen in FIG. 16, the top ramp's inclined surface has forced the top movable plate 120 to move downward, and the bottom ramp's inclined surface has forced the bottom plate 130 to be moved upward. In this position, the two plates 120 and 130 are now in a "locking position," and have essentially latched the overall attachment 10 into place on the DeWalt tool. The attachment will remain in this position until the rotatable collar 110 is caused to rotate back to its previous position, as shown on FIG. 16.

By viewing FIGS. 15 and 16, one can deduce certain general features about the overall locking subassembly used in this adapter 100. For example, the ramps 116 and 118 both protrude inward (i.e., toward the longitudinal axis 102), and both ramps are positioned along an inner circumference of the rounded interior portion 114 of the rotatable collar 110. These ramps are designed to essentially squeeze the two movable plates 120 and 130 toward the longitudinal axis 102 when the collar is rotated in a predetermined direction—which means the plates move in a radial direction with respect to that longitudinal axis 102. To do so, the ramps 116 and 118 are preferably designed with a smooth, cam-type profile that gradually reduces the internal radial distance between the innermost surface of the ramp and the centerline or longitudinal axis, as one traverses along the inner circumference 114 of the collar 110. In other words, the ramps exhibit a non-uniform distance that comprises a continuously increasing thickness along that inner circumference, in the illustrated embodiment.

The autofeed attachment could use more than two movable plates, if desired. For example, if three such movable plates were used, they would probably be mounted equidistant around the circumference of the inner circular (or cylindrical) shape of the rotatable collar. Regardless of the exact spacing between the movable plates, there would need to be a set of ramp structures on the interior surface of the rotatable collar that will come into contact with each one of the movable plates, so as to force each movable plate toward the interior when it is time to mount the autofeed attachment to the manual-feed screw gun.

Furthermore, the autofeed attachment could be provided with only a single movable plate that is designed to fit within the recess of the manual-feed power tool. Other, non-movable structural members could then hold the bottom (opposite) portion of the autofeed attachment to the power tool's housing.

Note that some of the embodiments illustrated herein do not have all of their components included on some of the figures herein, for purposes of clarity. To see examples of such outer housings and other components, especially for earlier designs, the reader is directed to other U.S. patents and applications owned by Senco. Similarly, information about "how" the electronic controller operates to control the functions of the tool is found in other U.S. patents and applications owned by Senco. Moreover, other aspects of the present tool technology may have been present in earlier fastener driving tools sold by the Assignee, Kyocera Senco Industrial Tools, Inc., including information disclosed in previous U.S. patents and published applications. Examples of such publications are listed above. These documents are incorporated by reference herein, in their entirety.

It will be further understood that any type of product described herein that has moving parts, or that performs functions (such as computers with processing circuits and memory circuits), should be considered a "machine," and not merely as some inanimate apparatus. Such "machine" devices should automatically include power tools, printers, electronic locks, and the like, as those example devices each have certain moving parts. Moreover, a computerized device that performs useful functions should also be considered a machine, and such terminology is often used to describe many such devices; for example, a solid-state telephone answering machine may have no moving parts, yet it is commonly called a "machine" because it performs well-known useful functions.

As used herein, the term "proximal" can have a meaning of closely positioning one physical object with a second physical object, such that the two objects are perhaps adjacent to one another, although it is not necessarily required that there be no third object positioned therebetween. In the technology disclosed herein, there may be instances in which a "male locating structure" is to be positioned "proximal" to a "female locating structure." In general, this could mean that the two male and female structures are to be physically abutting one another, or this could mean that they are "mated" to one another by way of a particular size and shape that essentially keeps one structure oriented in a predetermined direction and at an X-Y (e.g., horizontal and vertical) position with respect to one another, regardless as to whether the two male and female structures actually touch one another along a continuous surface. Or, two structures of any size and shape (whether male, female, or otherwise in shape) may be located somewhat near one another, regardless if they physically abut one another or not; such a relationship could still be termed "proximal." Or, two or more possible locations for a particular point can be specified in relation to a precise attribute of a physical object, such as being "near" or "at" the end of a stick; all of those possible near/at locations could be deemed "proximal" to the end of that stick. Moreover, the term "proximal" can also have a meaning that relates strictly to a single object, in which the single object may have two ends, and the "distal end" is the end that is positioned somewhat farther away from a subject point (or area) of reference, and the "proximal end" is the other end, which would be positioned somewhat closer to that same subject point (or area) of reference.

It will be understood that the various components that are described and/or illustrated herein can be fabricated in various ways, including in multiple parts or as a unitary part for each of these components, without departing from the principles of the technology disclosed herein. For example, a component that is included as a recited element of a claim hereinbelow may be fabricated as a unitary part; or that component may be fabricated as a combined structure of several individual parts that are assembled together. But that "multi-part component" will still fall within the scope of the claimed, recited element for infringement purposes of claim interpretation, even if it appears that the claimed, recited element is described and illustrated herein only as a unitary structure.

All documents cited in the Background and in the Detailed Description are, in relevant part, incorporated herein by reference; the citation of any document is not to be construed as an admission that it is prior art with respect to the technology disclosed herein.

The foregoing description of a preferred embodiment has been presented for purposes of illustration and description. It is not intended to be exhaustive or to limit the technology disclosed herein to the precise form disclosed, and the technology disclosed herein may be further modified within the spirit and scope of this disclosure. Any examples described or illustrated herein are intended as non-limiting examples, and many modifications or variations of the examples, or of the preferred embodiment(s), are possible in light of the above teachings, without departing from the spirit and scope of the technology disclosed herein. The embodiment(s) was chosen and described in order to illustrate the principles of the technology disclosed herein and its practical application to thereby enable one of ordinary skill in the art to utilize the technology disclosed herein in various embodiments and with various modifications as are suited to particular uses contemplated. This application is therefore intended to cover any variations, uses, or adaptations of the technology disclosed herein using its general principles. Further, this application is intended to cover such departures from the present disclosure as come within known or customary practice in the art to which this technology disclosed herein pertains and which fall within the limits of the appended claims.

What is claimed is:

1. An autofeed screw gun attachment, comprising:

(a) a housing having an open first end used for attaching and an opposite, second end used for driving a fastener, said housing having a longitudinal axis that extends through at least a portion of the open first end;

(b) an adapter portion proximal to said open first end, said adapter portion comprising:

(i) a rotatable collar having a rounded exterior surface that is graspable by a human hand, said rotatable collar having a rounded interior portion that includes at least one ramp that protrudes inward at a non-uniform distance along an inner circumference of the rounded interior portion;

(ii) at least one movable plate that is mounted within an interior volume of said rotatable collar, said at least one movable plate having a first surface that is sized and shaped to make physical contact with said at least one ramp of the rotatable collar, said at least one movable plate having a second surface that is sized and shaped to act as a locking surface;

(iii) at least one biasing member for urging said movable plate toward a first position that is distal from said longitudinal axis;

(iv) a first retainer that is mounted within the housing, said first retainer being positioned proximal to a first side of said at least one movable plate, said first side being proximal to the open first end of said housing;

(v) a second retainer that is mounted within the housing, said second retainer being positioned proximal to a second, opposite side of said at least one movable plate, said second side being more distal from the open end of said housing; and (vi) said first retainer and said second retainer are spaced apart from one another, thereby forming a gap, and said at least one movable plate is substantially contained within that gap;

(c) wherein: said at least one movable plate is displaceable toward a second position that is proximal to said longitudinal axis, said displacement being caused by contact with said at least one ramp of the rotatable collar.

2. The attachment of claim 1, wherein: said first and second retainers are mechanically coupled within said housing, while maintaining said spaced apart relationship, and while allowing said collar to be rotated about said longitudinal axis and said at least one movable plate to be moved in a radial direction with respect to said longitudinal axis.

3. The attachment of claim 1, wherein: the non-uniform distance of said at least one ramp comprises a continuously increasing thickness along the inner circumference of the rounded interior portion, which forces said at least one movable plate inward as said rotatable collar is rotated in a first rotational direction.

4. The attachment of claim 1, wherein: said at least one biasing member comprises at least one spring.

5. The attachment of claim 1, wherein: said first retainer comprises a retaining end cap that, using fasteners, holds said rotatable collar and said second retainer together.

6. The attachment of claim 1, wherein: said second retainer comprises an inner retainer that is in mechanical communication with an indexer that is positionable at various angles.

7. The attachment of claim 1, wherein: said at least one movable plate comprises two separate movable plates that are positioned on opposite sides of said attachment.

8. The attachment of claim 7, wherein: said at least one biasing member comprises two springs that are positioned between said two separate movable plates, said two springs each being mounted on a mounting post that is part of said two separate movable plates.

9. The attachment of claim 1, further comprising at least one O-ring.

10. A method for attaching a power tool attachment to a power tool, said method comprising:

(a) providing a power tool having a front end portion, in which an exterior surface of the front end portion includes a protruding flange portion and a recessed channel portion that are proximal to one another;

(b) providing a power tool attachment that includes an adapter portion used for mating against said front end portion of the power tool, said power tool attachment having a longitudinal axis that extends through said adapter portion, said adapter portion being proximal to an open end of the power tool attachment;

(c) said adapter portion comprises:

(i) a rotatable collar having a rounded exterior surface that is graspable by a human hand, said rotatable collar having a rounded interior portion that includes at least one ramp that protrudes inward at a non-uniform distance along an inner circumference of the rounded interior portion;

(ii) at least one movable plate that is mounted within an interior volume of said rotatable collar, said at least one movable plate having a first surface that is sized and shaped to make physical contact with said at least one ramp of the rotatable collar, said at least one movable plate having a second surface that is sized and shaped to substantially fit into said recessed channel portion of the power tool front end;

(iii) at least one biasing member for urging said movable plate toward a first position that is distal from said longitudinal axis;

(iv) a first retainer that is mounted within the rounded interior portion of said rotatable collar, said first retainer being positioned proximal to a first side of said at least one movable plate, said first side being proximal to the open end of the power tool attachment;

(v) a second retainer that is mounted within the rounded interior portion of said rotatable collar, said second retainer being positioned proximal to a second, opposite side of said at least one movable plate, said second side being more distal from the open end of the power tool attachment;

(vi) said second retainer is mechanically coupled to said first retainer; and (vii) said first retainer and said second retainer are spaced apart from one another, thereby forming a gap, and said at least one movable plate is contained within that gap;

(d) inserting said power tool front end onto the adapter portion of said attachment; and (e) rotating said rotatable collar, wherein:

(i) said at least one ramp rotates with the rotatable collar;

(ii) said non-uniform distance of the ramp forces said at least one movable plate to move inward, toward a second position; and (ii) when said at least one movable plate reaches the second position, it engages with said recessed channel portion of the power tool front end portion, thereby locking into position such that said power tool attachment becomes mounted to said power tool.

11. The method of claim 10, wherein: said at least one biasing member comprises at least one spring.

12. The method of claim 10, wherein: said first retainer comprises a retaining end cap that, using fasteners, holds said rotatable collar and said second retainer together.

13. The method of claim 10, wherein: said second retainer comprises an inner retainer that is in mechanical communication with an indexer that is positionable at various angles.

14. The method of claim 10, wherein: said at least one movable plate comprises two separate movable plates that are positioned on opposite sides of said attachment, wherein said two separate plates are engageable into opposite sides of said channel of said power tool front end portion.

15. The method of claim 14, wherein: said at least one biasing member comprises two springs that are positioned between said two separate movable plates, said two springs each being mounted on a mounting post that is part of said two separate movable plates.

16. The method of claim 10, further comprising at least one O-ring positioned proximal to said flange portion of the power tool front end portion.

17. A method for attaching a power tool attachment to a power tool, said power tool exhibiting a protruding front end with a round tip interrupted by flat portions, and having at least one external flange, said method comprising:

(a) inserting said power tool front end into an adapter portion of said attachment, said adapter comprising:

(i) a rotatable collar with an open interior circumference;

(ii) at least one ramp on the interior circumference of said rotatable collar;

(iii) at least one movable plate located within the interior circumference of said rotatable collar, said at least one movable plate including at least one spring to bias said at least one movable plate toward a first position;

(iv) a retaining end cap with an open interior circumference, located proximal to said rotatable collar;

(v) an inner retainer with an open interior circumference, located proximal to said rotatable collar, such that said at least one movable plate is contained between said inner retainer and said retaining end cap; and (vi) said inner retainer is mechanically coupled to said retaining end cap; and (b) rotating said collar, wherein:

(i) said at least one ramp rotates with said collar;

(ii) said at least one ramp forces said at least one movable plate toward a second position; and (iii) said at least one movable plate engages behind said at least one external flange of said power tool, thereby mounting the attachment to said power tool.

18. The method of claim 17, further comprising the steps of:

(a) inserting said power tool front end into said adapter portion of said attachment, said adapter comprising: an O-ring mounted within the interior circumference of said rotatable collar, said O-ring contained between said inner retainer, and said retaining end cap; and (b) rotating said collar, wherein: said O-ring is compressed against an opposite side of said at least one external flange of said power tool.

19. The method of claim 17, further comprising the step of:

(a) rotating said collar toward said first position, wherein said first position is an unlock position; and (b) thereby dismounting the attachment from said power tool.

20. A power tool attachment, said attachment comprising:

(a) an adapter, including:

(i) a rotatable collar with an open interior circumference;

(ii) at least one ramp on the interior circumference of said rotatable collar;

(iii) at least one movable plate located within the interior circumference of said rotatable collar, said at least one movable plate including at least one spring to bias said at least one movable plate into a first position;

(iv) a retaining end cap with an open interior circumference, proximal to said rotatable collar;

(v) an inner retainer with an open interior circumference, located proximal to said rotatable collar, such that said at least one movable plate is contained between said inner retainer and said retaining end cap; and (vi) said inner retainer is mechanically coupled to said retaining end cap.

21. The attachment of claim 20, further comprising: an O-ring mounted within the interior circumference of said rotatable collar, said O-ring contained between said inner retainer, and said retaining end cap.

22. The attachment of claim 20, wherein: said first position is an unlock position.

23. The attachment of claim 20, further comprising:

(a) a power tool having a protruding front end with a round tip interrupted by flat portions, and having at least one external flange;

(b) wherein:

(i) said at least one ramp rotates with said collar;

(ii) said at least one ramp forces said at least one movable plate into a second position; and (iii) said at least one movable plate engages behind said at least one external flange of said power tool.

* * * * *